US007826766B2

(12) United States Patent
Okabe

(10) Patent No.: US 7,826,766 B2
(45) Date of Patent: Nov. 2, 2010

(54) IMAGE FORMING APPARATUS CAPABLE OF PREVENTING DAMAGE DURING MOUNTING OF PHOTOSENSITIVE-MEMBER UNIT

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 163 days.

(21) Appl. No.: 11/966,526

(22) Filed: Dec. 28, 2007

(65) Prior Publication Data

US 2008/0181658 A1 Jul. 31, 2008

(30) Foreign Application Priority Data

Jan. 30, 2007 (JP) ..... 2007-019867

(51) Int. Cl.
*G03G 15/01* (2006.01)
*G03G 21/18* (2006.01)

(52) U.S. Cl. ..... 399/110; 399/112

(58) Field of Classification Search ..... 399/111, 399/112, 113, 110, 119
See application file for complete search history.

(56) References Cited

U.S. PATENT DOCUMENTS 5,402,212 A * 3/1995 Ito et al. ..... 399/111
6,400,917 B2 * 6/2002 Nakazato et al. ..... 399/111
6,708,011 B2 3/2004 Nomura et al.
7,567,769 B2 * 7/2009 Noguchi et al. ..... 399/110
2004/0240915 A1 * 12/2004 Nakayama ..... 399/345
2005/0220499 A1 * 10/2005 Kawahara et al. ..... 399/281
2007/0147885 A1 * 6/2007 Okabe et al. ..... 399/111

FOREIGN PATENT DOCUMENTS

JP 2003-015378 1/2003

* cited by examiner

*Primary Examiner*—Sophia S Chen
(74) *Attorney, Agent, or Firm*—Banner & Witcoff, Ltd

(57) ABSTRACT

A photosensitive-member unit includes a plurality of photosensitive members arranged in a first direction. The photosensitive-member unit is movable in the first direction to be mounted to or dismounted from a mount position in an apparatus main body. A positioning member is fixed to the apparatus main body and is configured to contact the photosensitive-member unit when the photosensitive-member unit is mounted at the mount position, thereby positioning the photosensitive-member unit at the mount position relative to the apparatus main body. A friction applying member is provided to one side of the apparatus main body with respect to a second direction perpendicular to the first direction. The photosensitive-member unit is configured to slidingly contact the friction applying member when the photosensitive-member unit moves to the mount position, allowing the friction applying member to apply a frictional force to the photosensitive-member unit.

19 Claims, 17 Drawing Sheets

26

IMAGE FORMING APPARATUS CAPABLE OF PREVENTING DAMAGE DURING MOUNTING OF PHOTOSENSITIVE-MEMBER UNIT

CROSS REFERENCE TO RELATED APPLICATIONS

This application claims priority from Japanese Patent Application No. 2007-019867 filed Jan. 30, 2007. The entire content of the priority application is incorporated herein by reference.

TECHNICAL FIELD

The invention relates to an image forming apparatus.

BACKGROUND

Color image forming apparatuses well known in the art, such as that disclosed in U.S. Pat. No. 6,708,011 (corresponding to Japanese Patent Application Publication No. 2003-15378), have been configured with a cartridge for integrally holding four photosensitive members and their peripheral components, the cartridge being detachably mounted in the body of the apparatus by sliding.

With this type of color image forming apparatus, it is necessary to position the cartridge for the photosensitive members accurately relative to the body of the apparatus. Since the cartridge is detachably mounted in the body of the image forming apparatus while an exposure unit is fixed to the body, the cartridge for the photosensitive members must be accurately positioned in the body of the apparatus when mounted therein in order to position the photosensitive members accurately relative to the exposure unit.

To achieve this, positioning members have been provided in the body of the conventional apparatus for contacting and positioning the cartridge accommodating the photosensitive members. However, since the cartridge is detachably mounted in the body of the apparatus by sliding, the cartridge collides forcibly with the positioning members when vigorously slid into the body of the apparatus. The impact of such collisions may cause damage to the positioning members and/or parts of the cartridge that contact the positioning members.

SUMMARY

In view of the foregoing, it is an object of the invention to provide an image forming apparatus capable of preventing damage to positioning members in the body of the image forming apparatus and parts of a photosensitive-member unit that come into contact with the positioning members when the photosensitive-member unit is mounted in the image forming apparatus.

In order to attain the above and other objects, the invention provides an image forming apparatus. The image forming apparatus includes an apparatus main body, a photosensitive-member unit, a positioning member, and a friction applying member. The photosensitive-member unit includes a plurality of photosensitive members arranged in a first direction. The photosensitive-member unit is movable in the first direction to be mounted to or dismounted from a mount position in the apparatus main body. The positioning member is fixed to the apparatus main body and is configured to contact the photosensitive-member unit when the photosensitive-member unit is mounted at the mount position, thereby positioning the photosensitive-member unit at the mount position relative to the apparatus main body. The friction applying member is provided to one side of the apparatus main body with respect to a second direction perpendicular to the first direction. The photosensitive-member unit is configured to slidingly contact the friction applying member when the photosensitive-member unit moves to the mount position, allowing the friction applying member to apply a frictional force to the photosensitive-member unit.

BRIEF DESCRIPTION OF THE DRAWINGS

Embodiments in accordance with the invention will be described in detail with reference to the following figures wherein.

DETAILED DESCRIPTION

An image forming apparatus according to an embodiment of the invention will be described while referring to FIGS. 1 through 11C. The image forming apparatus of the embodiment is applied to a color laser printer.

Figure 1:
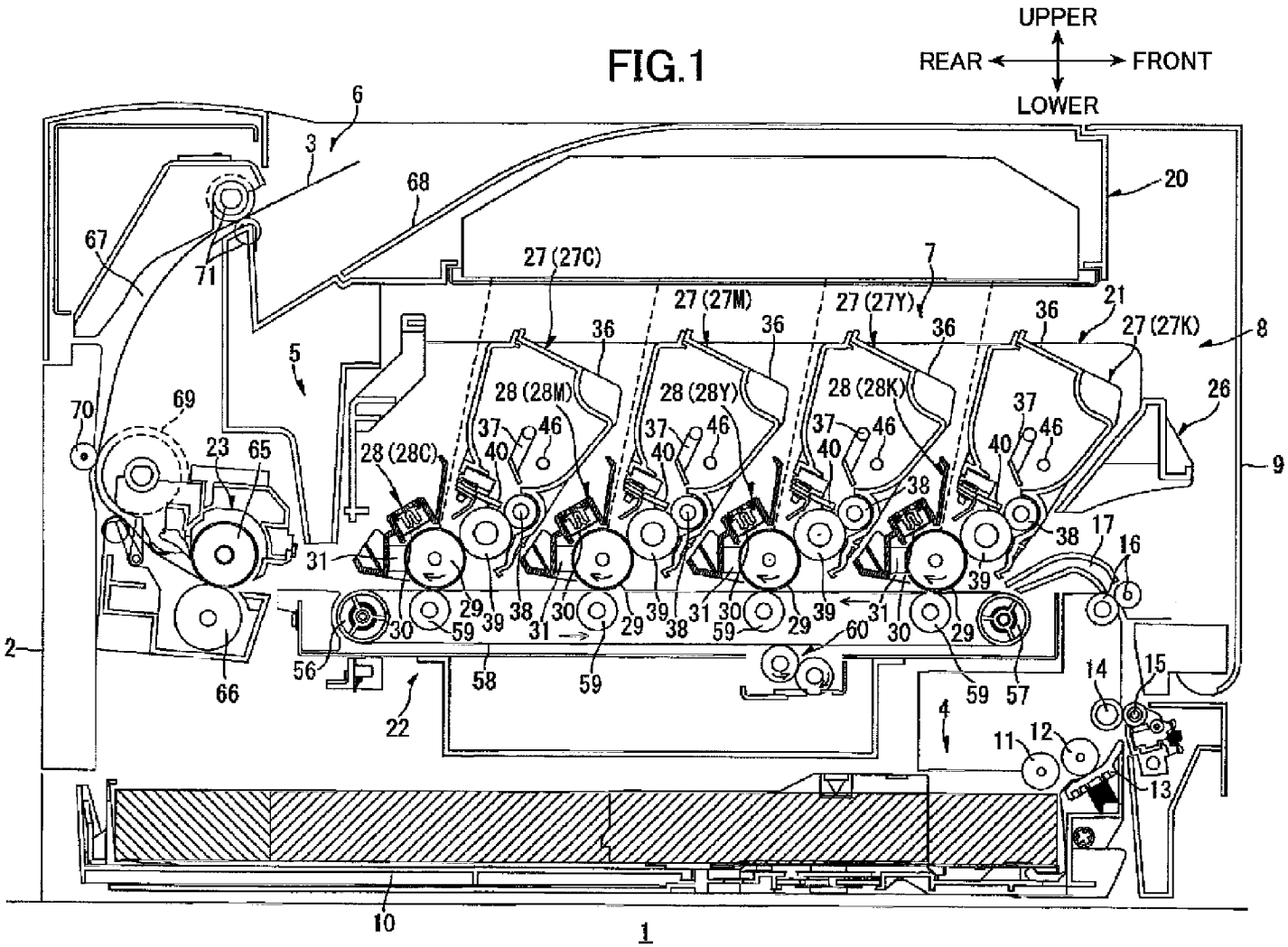
FIG. 1 is a vertical cross-sectional view showing the structure of a color laser printer embodying an image forming apparatus according to an embodiment of the invention.

As shown in FIG. 1, a color laser printer 1 is a transversal tandem color laser printer including a plurality of photosensitive drums 29 described later arranged in the horizontal direction.

The color laser printer 1 includes a main casing 2 and, within the main casing 2, a feeding unit 4 for feeding sheets of paper 3, an image-forming unit 5 for forming images on the fed paper 3, and a discharge unit 6 for discharging the paper 3 formed with the images.

(1) Main Casing

The main casing 2 is shaped like a substantially rectangular box in a side view. A drum accommodating space 7 is formed inside the main casing 2 for accommodating a drum unit 26 described later.

A front wall of the main casing 2 is formed with an access opening 8 in communication with the drum accommodating space 7, and is provided with a front cover 9 capable of opening and closing over the access opening 8. The front cover 9 is supported so as to be movable between an opened state where the front cover 9 inclines forward to open the access opening 8 and a closed state where the front cover 9 stands along the front surface of the main casing 2 to close the access opening 8. When the front cover 9 is open, the access opening 8 is exposed, enabling the drum unit 26 to be mounted into or removed from the drum accommodating space 7 in the main casing 2 via the access opening 8.

Note that in the following description, the expressions "front", "rear", "left", "right", "above", and "below" are used to define the various parts when the color laser printer 1 is disposed in an orientation in which it is intended to be used. More specifically, a side of the color laser printer 1 on which the front cover 9 is provided is referred to "front" side, while a side opposite the front side is referred to "rear" side. Further, "left" and "right" sides are used to define the left and right sides of the color laser printer 1 when the color laser printer 1 is viewed from the front side. Regarding the drum unit 26, the expressions "front", "rear", "left", "right", "above", and "below" are used to define parts of the drum unit 26 when the drum unit 26 is mounted on the main casing 2.

(2) Feeding Unit

The feeding unit 4 includes a paper tray 10 that is detachably mounted in the bottom section of the main casing 2; a pickup roller 11 disposed above the front end of the paper tray 10; a substantially U-shaped feeding path 17 leading from a position above the front end of the paper tray 10 to a conveying belt 58 described later; and a separating roller 12, a separating pad 13, a pinch roller 14, a paper dust roller 15, and a pair of registration rollers 16 disposed along the feeding path 17.

By rotating, the pickup roller 11 conveys sheets of the paper 3 stacked in the paper tray 10 along the feeding path 17. The separating roller 12 and separating pad 13 separate the conveyed sheets of paper 3 so that only one sheet is fed onto the feeding path 17 at a time. The paper dust roller 15 removes dust from the paper 3 as the paper 3 passes between the pinch roller 14 and paper dust roller 15 while being conveyed to the registration rollers 16. The registration rollers 16 register the paper 3 and subsequently convey the paper 3 onto the conveying belt 58.

(3) Image-forming Unit

The image-forming unit 5 includes a scanning unit 20, a process unit 21, a transfer unit 22, and a fixing unit 23.

(3-1) Scanning Unit

The scanning unit 20 is disposed in the top section of the main casing 2. The scanning unit 20 includes lasers, mirrors, lenses, and other optical components, by which the scanning unit 20 emits four laser beams toward the four photosensitive drums 29 described later. As indicated by the dotted lines in FIG. 1, the laser beams are irradiated onto the surfaces of the photosensitive drums 29 in a high-speed scan.

(3-2) Process Unit

The process unit 21 is disposed in the main casing 2 below the scanning unit 20 and above the feeding unit 4. The process unit 21 includes the single drum unit 26, and four developer cartridges 27 corresponding to the colors black, yellow, magenta, and cyan (specifically, developer cartridges 27K, 27Y, 27M, and 27C).

(3-2-1) Drum Unit

The tandem-type drum unit 26 is accessed through the access opening 8 and can be moved in or out of the main casing 2 via the access opening 8 by sliding the drum unit 26 horizontally. The drum unit 26 is provided with four drum subunits 28 corresponding to each of the above colors.

Figure 2:
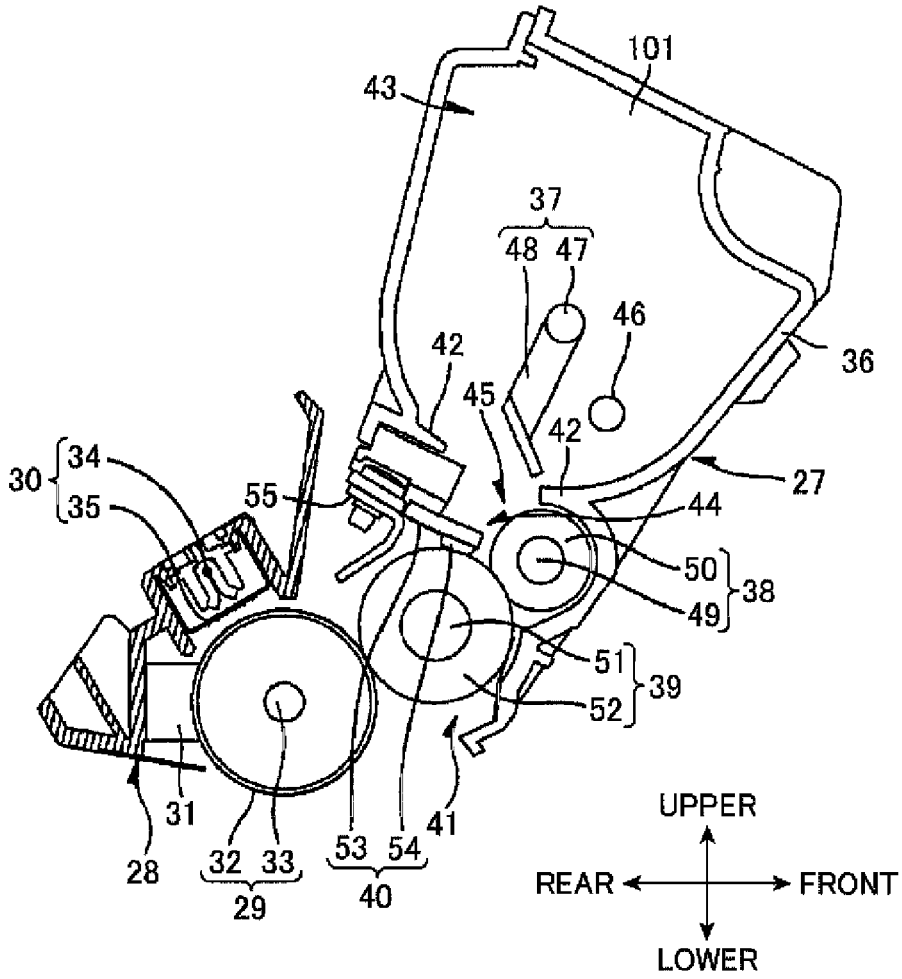
FIG. 2 is a vertical cross-sectional view of a developer cartridge and a drum subunit shown in FIG. 1.

The drum subunits 28 are juxtaposed and spaced at intervals in the front-to-rear direction. In order from front to rear, the drum subunits 28 include a black drum subunit 28K, a yellow drum subunit 28Y, a magenta drum subunit 28M, and a cyan drum subunit 28C. FIG. 2 is a side cross-sectional view of the developer cartridge 27 and drum subunit 28.

As shown in FIG. 2, each drum subunit 28 includes the photosensitive drum 29, a Scorotron charger 30, and a cleaning brush 31.

The photosensitive drum 29 extends in the left-to-right direction and includes a main drum body 32 and a drum shaft 33. The main drum body 32 is cylindrical in shape and has a positive charging photosensitive layer formed of polycarbonate or the like on its outer surface. The drum shaft 33 extends along the axial direction of the main drum body 32 and freely rotatably supports the main drum body 32. Both ends of the drum shaft 33 in its axial direction are inserted through the side frames 134 described later and are supported on a pair of side plates 133 described later so as not to be able to rotate. During printing operations, the photosensitive drum 29 is driven to rotate by a motor (not shown) disposed within the main casing 2.

The charger 30 is disposed diagonally above and rearward of the photosensitive drum 29. The charger 30 confronts the photosensitive drum 29 but is spaced away from the photosensitive drum 29. The charger 30 includes a discharge wire 34 and a grid 35. The discharge wire 34 is disposed in confrontation with the photosensitive drum 29, but is spaced away therefrom. The grid 35 is disposed between the photosensitive drum 29 and the discharge wire 34. During printing operations, a high voltage is applied to each of the discharge wire 34 and the grid 35.

The cleaning brush 31 is disposed on the rear side of the photosensitive drum 29 so as to confront and contact the same. During image formation, a cleaning bias is applied to the cleaning brush 31.

(3-2-2) Developer Cartridge

As shown in FIG. 1, the developer cartridges 27 are disposed in confrontation with the drum subunits 28 of each color. Specifically, the black developer cartridge 27K is disposed in confrontation with the black drum subunit 28K, the yellow developer cartridge 27Y in confrontation with the yellow drum subunit 28Y, a magenta developer cartridge 27M in confrontation with the magenta drum subunit 29M, and a cyan developer cartridge 27C in confrontation with the cyan drum subunit 28C.

As shown in FIG. 2, the developer cartridge 27 includes a case 36, within which are provided an agitator 37, a supply roller 38, a developing roller 39, and a thickness-regulating blade 40.

The case 36 is box-shaped with an opening 41 formed in the bottom end thereof. A partition wall 42 divides the interior of the case 36 into a toner-accommodating chamber 43 in the upper region of the case 36, and a developing chamber 44 in the lower region of the case 36. An opening 45 is formed in the partition wall 42 to allow communication between the toner-accommodating chamber 43 and developing chamber 44.

The toner-accommodating chamber 43 accommodates toner in a color corresponding to the color of the developer cartridge 27. The toner is a positive-charging, nonmagnetic, single-component polymer toner combined with a coloring agent for each of the colors yellow, magenta, cyan, and black. Windows 46 are formed in both left and right side walls 101 of the case 36 for detecting the amount of toner remaining in the toner-accommodating chamber 43.

The agitator 37 is disposed inside the toner-accommodating chamber 43. The agitator 37 includes an agitator rotational shaft 47 and an agitating member 48. The agitator rotational shaft 47 is rotatably supported on side walls 101 of the casing 36. The agitating member 43 is provided in the axial direction of the agitator rotational shaft 47 and extends outward from the agitator rotational shaft 47 in the radial direction. During the printing operations, a driving force is transmitted to the agitator rotational shaft 47 from a motor (not shown) provided in the main casing 2. As a result, the agitating member 48 moves circuitously in the toner-accommodating chamber 43.

The supply roller 38 is disposed inside the developing chamber 44 and below the opening 45. The supply roller 38 includes a metal roller shaft 49 covered by a sponge roller 50 formed of an electrically conductive sponge material. The metal roller shaft 49 is rotatably supported on the side walls 101 of the casing 36. During printing operations, a driving force is applied from the motor (not shown), thereby rotating the supply roller 38.

The developing roller 39 is disposed in the developing chamber 44 diagonally below and rearward of the supply roller 38. The developing roller 39 includes a metal developing roller shaft 51 rotatably supported in the side walls 101 of the case 36, and a rubber roller 52 formed of an electrically conductive rubber for covering the developing roller shaft 51. A portion of the peripheral surface on the rubber roller 52 is exposed below the developing chamber 44 through the opening 41. The rubber roller 52 contacts the sponge roller 50 of the supply roller 38 with pressure. During image formation, the motor (not shown) disposed in the main casing 2 generates a drive force that is transmitted to the developing roller 39 for rotating the same. A developing bias is also applied to the developing roller 39.

The thickness regulating blade 40 is disposed inside the developing chamber 44 and contacts the developing roller 39 with pressure from the above. The thickness regulating blade 40 includes a blade 53 made of a metal leaf spring and a pressing portion 54 provided on a free end of the blade 53. The pressing portion 54 is formed of an electrically-insulating silicon rubber in a semi-circular shape in cross-section.

A base end of the blade 53 is fixed to the partitioning wall 42 by a fixing member 55. A resilient force of the blade 53 presses the pressing portion 54 on its free end against the rubber roller 52 of the developing roller 39 from the above.

(3-2-3) Developing Operation in Process Unit

In each of the developing cartridges 27, the toner of the corresponding color accommodated in the toner-accommodating chamber 43 moves toward the opening 45, and is discharged to the developing chamber 44 through the opening 45 while being agitated by the agitator 37.

The toner discharged through the opening 45 into the developing chamber 44 is supplied to the supply roller 38, and further to the developing roller 39 by the rotation of the supply roller 38. At this time, the toner is positively tribocharged between the supply roller 38 and the developing roller 39 applied with the developing bias.

The toner supplied to the developing roller 39 is conveyed to a position between the rubber roller 52 of the developing roller 39 and the pressing portion 54 of the thickness regulating blade 40 by the rotation of the developing roller 39, and is borne in a thin layer with a certain thickness on the surface of the rubber roller 52.

As the photosensitive drum 29 corresponding to each developer cartridge 27 rotates, the respective charger 30 charges the surface of the photosensitive drum 29 with a uniform positive polarity. The scanning unit 20 subsequently irradiates a laser beam onto the surface of the positively charged photosensitive drum 29, as shown in FIG. 1, forming an electrostatic latent image on the photosensitive drum 29 corresponding to an image to be formed on the paper 3.

As the photosensitive drum 29 continues to rotate, bringing the electrostatic latent image on the surface of the photosensitive drum 29 against the developing roller 39, the positively charged toner borne on the surface of the developing roller 39 is attracted to the electrostatic latent image (i.e., regions on the surface of the positively charged photosensitive drum 29 exposed to the laser beam and, therefore, having a lower potential). In this way, the latent image is developed into a visible image through reverse development, so that a toner image in the corresponding color is borne on the surface of the photosensitive drum 29.

(3-3) Transfer Unit

The transfer unit 22 is disposed in the main casing 2 above the feeding unit 4 and below the process unit 21. The transfer unit 22 includes a drive roller 56, a follow roller 57, the conveying belt 58, and four transfer rollers 59.

The drive roller 56 and the follow roller 57 are disposed so as to be spaced away from each other in the front-to-rear direction. The conveying belt 58 is an endless belt and is looped around the drive roller 56 and the follow roller 57.

During the printing operation, the drive roller 56 is driven to rotate by a driving force transmitted from a motor (not shown) disposed inside the main casing 2. When the drive roller 56 rotates, the conveying belt 59 moves circuitously between the drive roller 56 and the follow roller 57, such that the convey belt 58 moves in the same direction as the photosensitive drums 29 at transfer positions where the convey belt 58 contacts the photosensitive drums 29. Also, the follow roller 57 rotates in association with the movement of the convey belt 58.

Each transfer roller 59 is disposed inside the conveying belt 58 in confrontation with the corresponding photosensitive drum 29 with the conveying belt 58 interposed therebetween. The transfer rollers 59 followingly rotate such that the transfer rollers 59 move in the same direction as the conveying belt 58 at the transfer positions where the transfer rollers 59 contacts the conveying belt 58. During the printing operations, a transfer bias is applied to each transfer roller 59.

A sheet of paper 3 fed from the feeding unit 4 is conveyed by the conveying belt 58 so as to sequentially pass the transfer positions of the respective photosensitive drums 29 from the front side toward the rear side. During the conveyance, toner images borne on the photosensitive drums 29 are sequentially transferred onto the sheet of paper 3, thereby forming a color image on the paper 3.

The developing roller 39 recovers residual toner remaining on the photosensitive drum 29 after a transfer operation. The cleaning brush 31 functions to remove paper dust deposited on the photosensitive drum 29 by the paper 3 during a transfer operation.

(3-4) Fixing Unit

The fixing unit 23 is disposed in the main casing 2 rearward of the transfer unit 22. The fixing unit 23 includes a heating roller 65, and a pressure roller 66 that applies pressure to the heating roller 65.

The fixing unit 23 fixes the transferred color image to the paper 3 by heat and pressure as the paper 3 passes between the heating roller 65 and the pressure roller 66.

(4) Discharge Unit

The discharge unit 6 includes a substantially C-shaped discharge path 67 leading from the fixing unit 23 to the top of the main casing 2; and a conveying roller 69, a pinch roller 70, and a pair of discharge rollers 71 disposed along the discharge path 67. When a sheet of paper 3 is conveyed from the fixing unit 23, the conveying roller 69 and pinch roller 70 convey the sheet along the discharge path 67, and the discharge rollers 71 receive and discharge the paper 3 onto a discharge tray 68 formed on the top surface of the main casing 2.

2. Drum Unit

Figure 3:
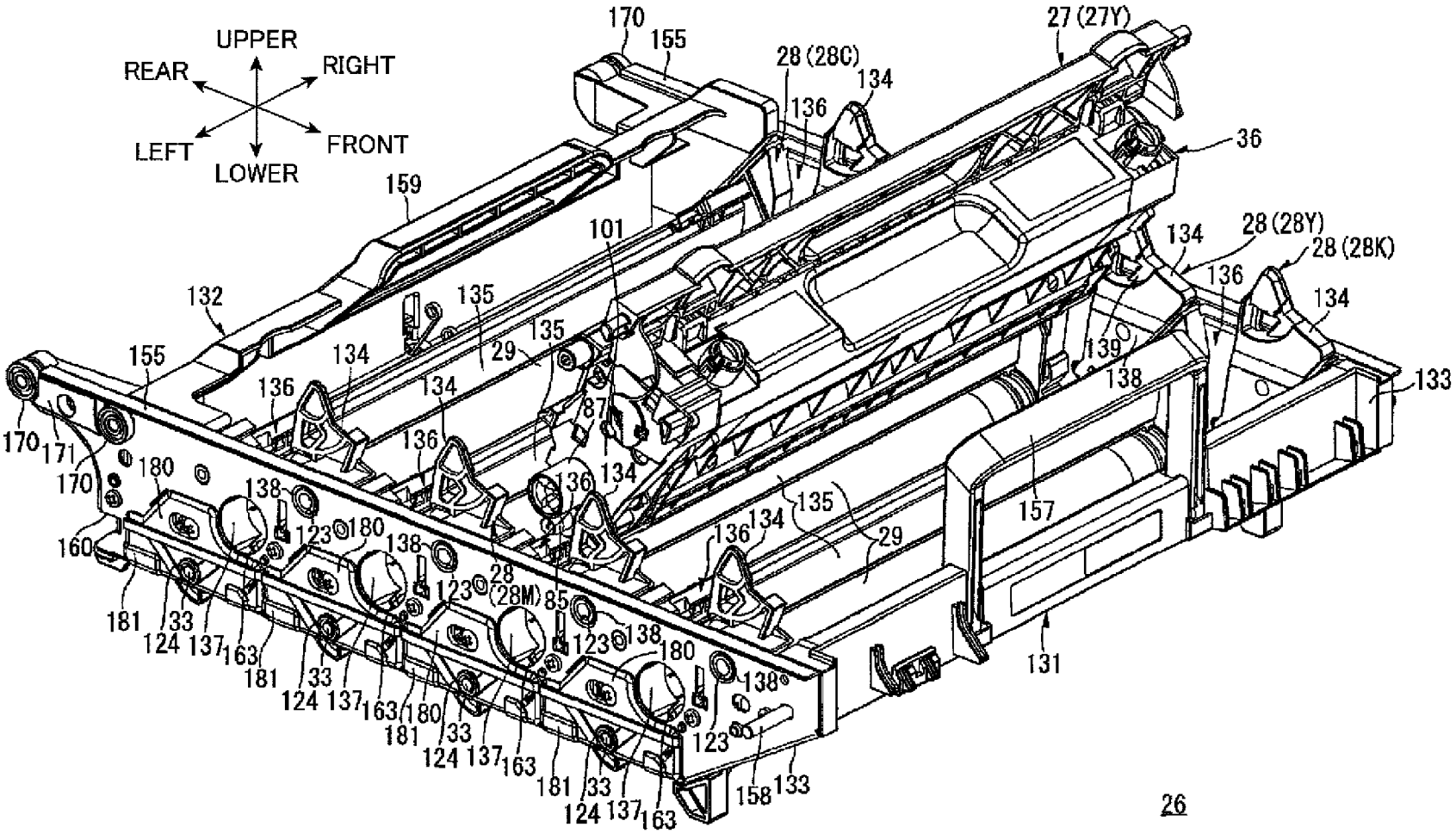
FIG. 3 is a perspective view of a drum unit shown in FIG. 1 as viewed from the left front side.
Figure 4:
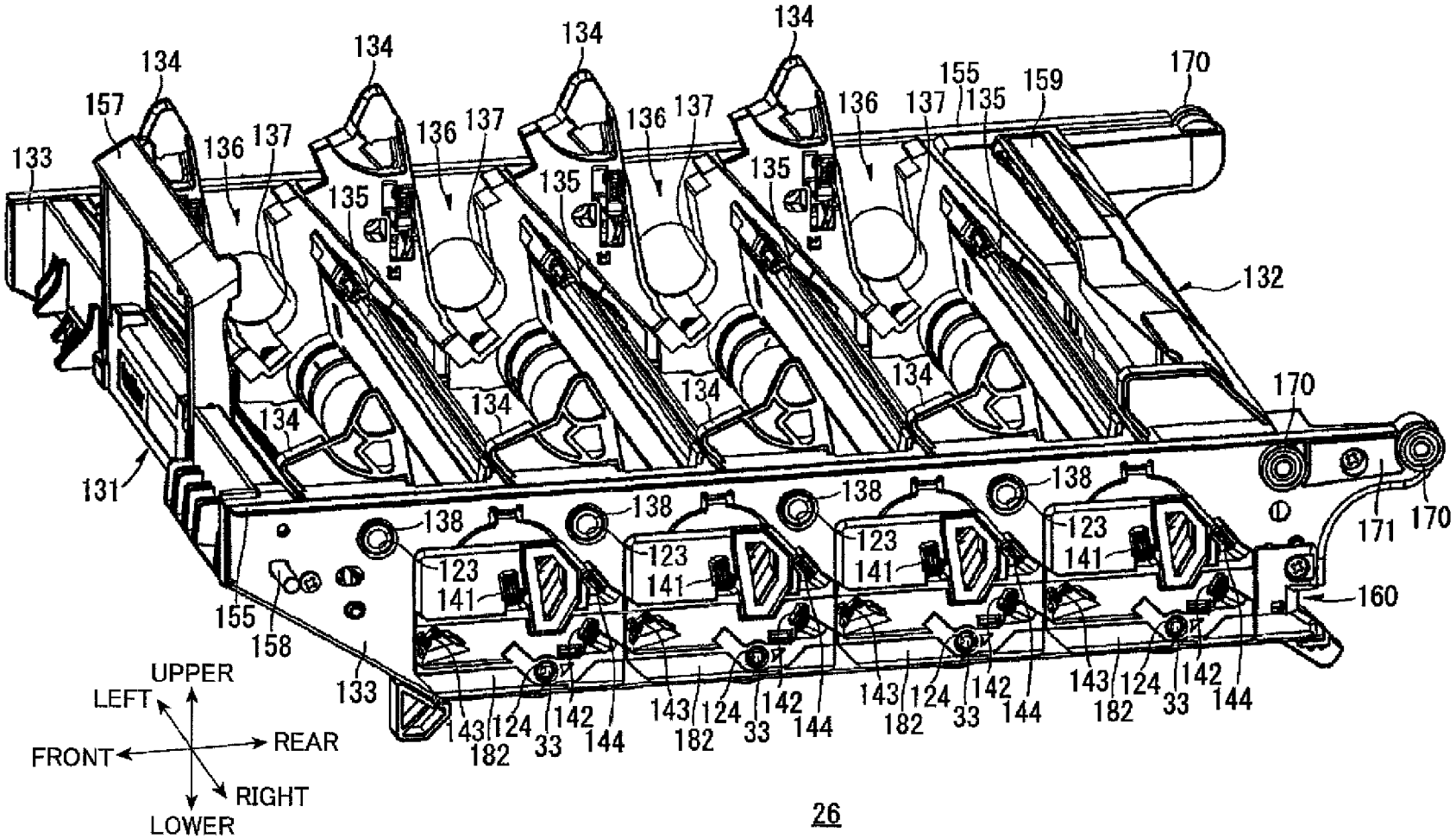
FIG. 4 is a perspective view of the drum unit as viewed from the right front side.
Figure 5:
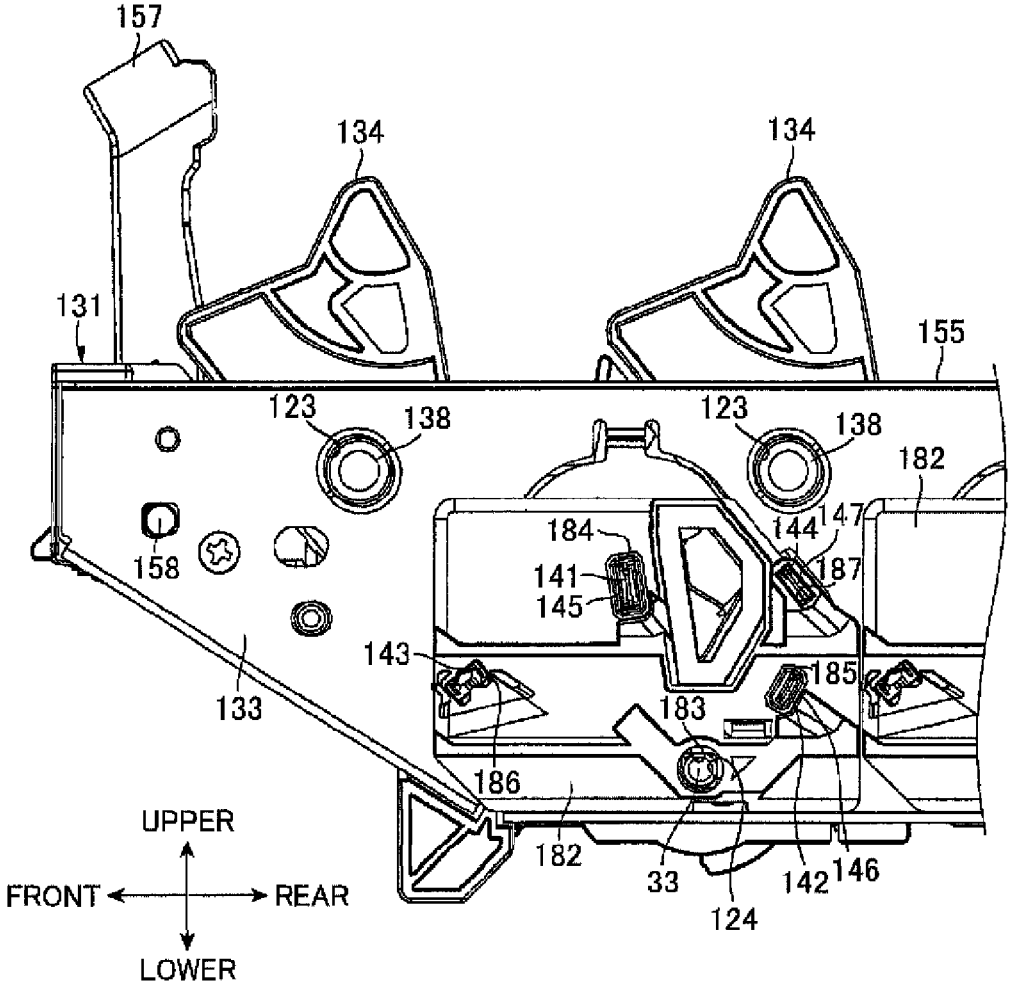
FIG. 5 is an enlarged right side view showing a part of the drum unit.

FIG. 3 is a perspective view of the drum unit 26 from the left front side. FIG. 4 is a perspective view of the drum unit 26 from the right front side. FIG. 5 is a right side view of the drum unit 26. In FIG. 3, the yellow developer cartridge 27Y is shown being mounted in the drum unit 26.

The drum unit 26 includes the four drum subunits 28 juxtaposed in the front-to-rear direction; a front beam 131 arranged on the front side of the drum subunits 28; a rear beam 132 arranged on the rear side of the drum subunits 28; and a pair of side plates 133 arranged on the left and right sides of the four drum subunits 28, the front beam 131, and the rear beam 132.

(1) Drum Subunits

Each drum subunit 28 includes a pair of side frame walls 134 positioned parallel to each other and separated in the left-to-right direction, and a center frame member 135 spanning between the side frame walls 134 in the left-to-right direction.

Each side frame wall 134 is formed of a resin material in a plate shape. The drum shaft 33 of the photosensitive drum 29 is inserted through the corresponding pairs of side frame walls 134. A cartridge guiding groove 136 is formed in each side frame wall 134 for guiding the developer cartridge 27 when the developer cartridge 27 is mounted in the drum subunit 28.

The cartridge guiding groove 136 is formed from the upper rear end of the side frame wall 134 to a position near the lower front end of the side frame wall 134 so that the cartridge guiding groove 136 slopes downward toward the rear. The bottom end (deepest part) of the cartridge guiding groove 136 corresponds to the position of the developing roller shaft 51 when the developing roller 39 is in contact with the photosensitive drum 29. The developing roller shaft 51 penetrates both side walls 101 of the case 36 constituting the developer cartridge 27. Collar members 85 cap the ends of the developing roller shaft 51 protruding from the side walls 101. The collar members 85 are slidably received in the corresponding cartridge guiding grooves 136.

A cylindrical boss 138 is formed on each side frame wall 134 and protrudes outward in the width direction from the side frame wall 134. When the developer cartridge 27 is mounted in the drum subunit 28, the cylindrical bosses 138 are positioned so as to confront the windows 46 of the developer cartridge 27 (see FIG. 2) in the width direction. An inner coupling insertion hole 137 is formed in each side frame wall 134 on the left side. A coupling idler gear 87 on the developer cartridge 27 is positioned in the respective inner coupling insertion hole 137. The coupling idler gear 87 functions to input a drive force for rotating the agitator 37, supply roller 38, and developing roller 38 (see FIG. 2) and is positioned on the left side wall 101 of the case 36 constituting the developer cartridge 27.

As shown in FIG. 4, a wire electrode 141, a grid electrode 142, a developing roller electrode 143, and a cleaning electrode 144 are supported in each right side frame wall 134 and penetrate the side frame wall 134 in the thickness direction so as to protrude outward in the width direction. As shown in FIG. 5, the wire electrode 141 is disposed in substantially the front-to-rear center of the side frame wall 134. A support member 145 formed integrally with the side frame wall 134 supports the wire electrode 141. The wire electrode 141 is electrically connected to the discharge wire 34 of the charger 30 (see FIG. 2).

As shown in FIG. 5, the grid electrode 142 is disposed diagonally rearward and below the wire electrode 141. A support member 146 formed integrally with the side frame wall 134 supports the grid electrode 142. The grid electrode 142 is electrically connected to the grid 35 of the charger 30 (see FIG. 2). The developing roller electrode 143 is disposed diagonally below and forward of the wire electrode 141 and is electrically connected to the developing roller shaft 51 of the developing roller 38 (see FIG. 2).

As shown in FIG. 5, the cleaning electrode 144 is disposed above the grid electrode 142. A support member 147 formed integrally with the side frame wall 134 supports the cleaning electrode 144. The cleaning electrode 144 is electrically connected to the cleaning brush 31 (see FIG. 2). The center frame member 135 retains the charger 30 and cleaning brush 31.

When the developer cartridge 27 is mounted in the drum subunit 28, the collar member 85 on the right end of the developing roller shaft 51 is connected to the developing roller electrode 143 provided in the right side frame wall 134. Further, the coupling idler gear 87 provided on the developer cartridge 27 is disposed in the inner coupling insertion hole 137 formed in the left side frame wall 134.

(2) Front Beam

The front beam 131 is integrally formed of a resin material. The front beam 131 includes a near-side grip 157 mounted in the widthwise center thereof, and a support shaft 158 for rotatably supporting the near-side grip 157.

The support shaft 158 is supported in the front beam 131, penetrating the front beam 131 in the width direction. The near-side grip 157 is formed substantially in a U-shape, each free end of the near-side grip 157 being rotatably supported on the support shaft 158. In this way, the near-side grip 157 can be pivoted between a loading position extending upright from the front beam 131, and an operating position pivoted down on the front side of the front beam 131.

(3) Rear Beam

The rear beam 132 is integrally formed of a resin material. A far-side grip 159 having a U-shape in a rear view is integrally provided in the widthwise center of the rear beam 132.

The free ends of the far-side grip 159 are coupled with the rear beam 132 so that the far-side grip 159 angles diagonally upward toward the front side.

(4) Side Plates

Each of the side plates 133 is formed of a material having a greater stiffness than the resin material used to form the drum subunit 28, front beam 131, and rear beam 132, such as a metal or fiber-reinforced resin, and preferably a steel sheet. The side plate 133 has a narrow rectangular plate shape extending in the front-to-rear direction. The front end of the side plate 133 is fixed to the front beam 131, while the rear end is fixed to the rear beam 132. The two side plates 133 are provided on the left and right sides of the four drum subunits 28 for holding the same.

The upper edge of each side plate 133 is bent outward in the width direction, giving the side plate 133 an L-Shaped cross section. In this way, a flange part 155 extending outward in the width direction is formed on the upper edge of each side plate 133, extending the front-to-rear direction thereof.

The rear end of each side plate 133 is formed substantially in an L-shape when viewed from the side so that the top portion extends rearward. Roller members 170 (an example of a guide-rail supported member) are rotatably disposed in the rearward-extending portion. A spacer 171 is interposed between the two roller members 170 in the front-to-rear direction. The front roller member 170 is disposed below the flange part 155, while the rear roller member 170 is disposed rearward from the rear edge of the flange part 155.

A notched part 160 substantially rectangular in shape when viewed from the side is formed in the rear edge of each side plate 133. More specifically, the notched part 160 is formed in the rear edge of each side plate 133 so that the upper edge of the notched part 160 extends in the front-to-rear direction (horizontally) in a straight line, while the lower edge of the notched part 160 slopes upward from the rear edge of the side plate 133 at a predetermined gradient and in a straight line. The front edge of the notched part 160 is formed vertically in a straight line so as to connect the front end of the upper edge to the front end of the lower edge. When the drum unit 26 is mounted in the main casing 2, the notched parts 160 receive a reference shaft 203 described later and grip the reference shaft 203 from above and below.

Four light-transmitting holes 123 are formed in each side plate 133 near the upper edge thereof for receiving the cylindrical boss 138 on each drum subunit 28. Shaft holes 124 are formed in each side plate 133 near the lower edge thereof. The widthwise ends of the drum shaft 33 in the photosensitive drum 29 provided in each drum subunit 28 are inserted into the respective shaft holes 124. As shown in FIG. 3, outer coupling insertion holes 163 are formed in the left side plate 133 for communicating with the inner coupling insertion holes 137 formed in the left side surface of the drum subunits 28. In a state where the developer cartridge 27 is mounted in the drum subunit 28, the coupling idler gear 87 on the developer cartridge 27 confronts the corresponding outer coupling insertion holes 163.

Four left caps 180 are mounted on the outer surface of the left side plate 133. Each left cap 180 is formed of an insulating resin material. The lower portion of the left cap 180 is substantially rectangular-shaped in a side view and extends in the front-to-rear direction, while the upper portion of the left cap 180 is substantially trapezoidal-shaped when viewed from the side and protrudes upward. Each left cap 180 is arranged so that the lower edge thereof follows the lower edge of the side plate 133, while the upper trapezoidal-shaped portion is positioned rearward of the corresponding outer coupling insertion holes 163. A protruding part 181 having a substantially rectangular shape protrudes outward from the lower rear edge of each left cap 180.

Four electrode openings (not shown) are formed in the right side plate 133 at intervals in the front-to-rear direction. As shown in FIG. 4, each of the electrode openings exposes the respective wire electrode 141, grid electrode 142, developing roller electrode 143, and cleaning electrode 144 provided in the right side frame wall 134 of each drum subunit 28.

Four right caps 182 are mounted on the right side plate 133 for covering the electrode openings. Each right cap 182 is formed of an insulating resin material and has a trapezoidal shape in a side view. As shown in FIG. 5, each right cap 182 has formed therein a drum shaft opening 183 for exposing the drum shaft 33, a wire electrode opening 184 for exposing the wire electrode 141, a grid electrode opening 185 for exposing the grid electrode 142, a developing roller electrode opening 186 for exposing the developing roller electrode 143, and a cleaning electrode opening 187 for exposing the cleaning electrode 144. Each right cap 182 functions to expose the drum shaft 33, wire electrode 141, grid electrode 142, developing roller electrode 143, and cleaning electrode 144, while covering the electrode opening to prevent foreign matter from entering therein.

By forming the left caps 180 and right caps 182 of an insulating material, the caps also function to prevent electrical leakage from the wire electrodes 141, grid electrodes 142, developing roller electrodes 143, and cleaning electrodes 144.

3. Main Casing

Figure 6:
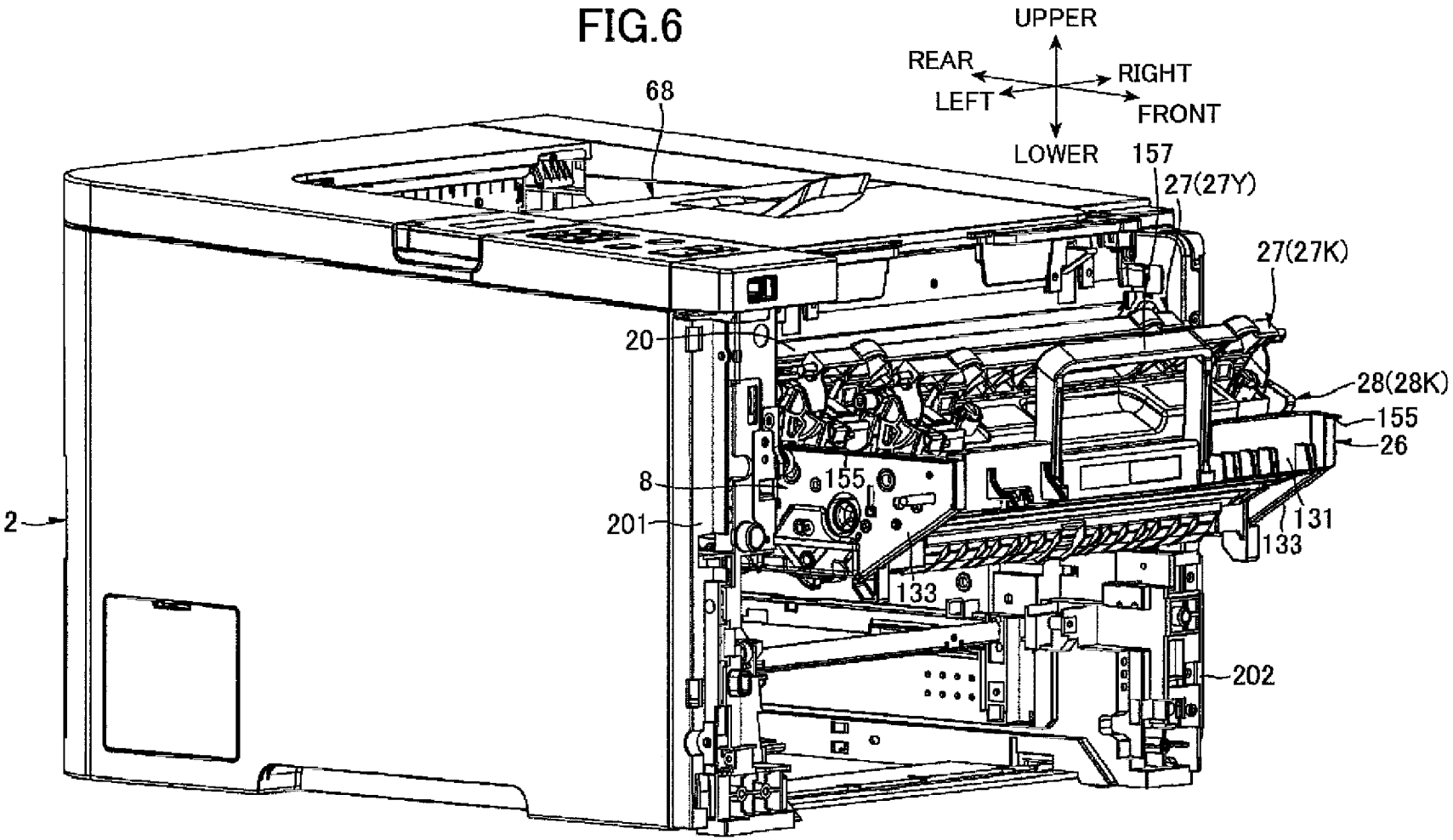
FIG. 6 is a perspective view of the color laser printer as viewed from the left front side.

FIG. 6 is a perspective view of the color laser printer 1 from the left front side. In FIG. 6, the front cover 9 and paper tray 10 have been removed from the main casing 2, and the drum unit 26 is partially mounted in the main casing 2.

The main casing 2 includes a left main frame wall 201 and a right main frame wall 202 disposed on either side of the drum unit 26 and confronting each other in the left-to-right direction. The scanning unit 20 bridges the upper portions of the main frame walls 201 and 202. The drum accommodating space 7 is formed below the scanning unit 20 and between the main frame walls 201 and 202.

Figure 7:
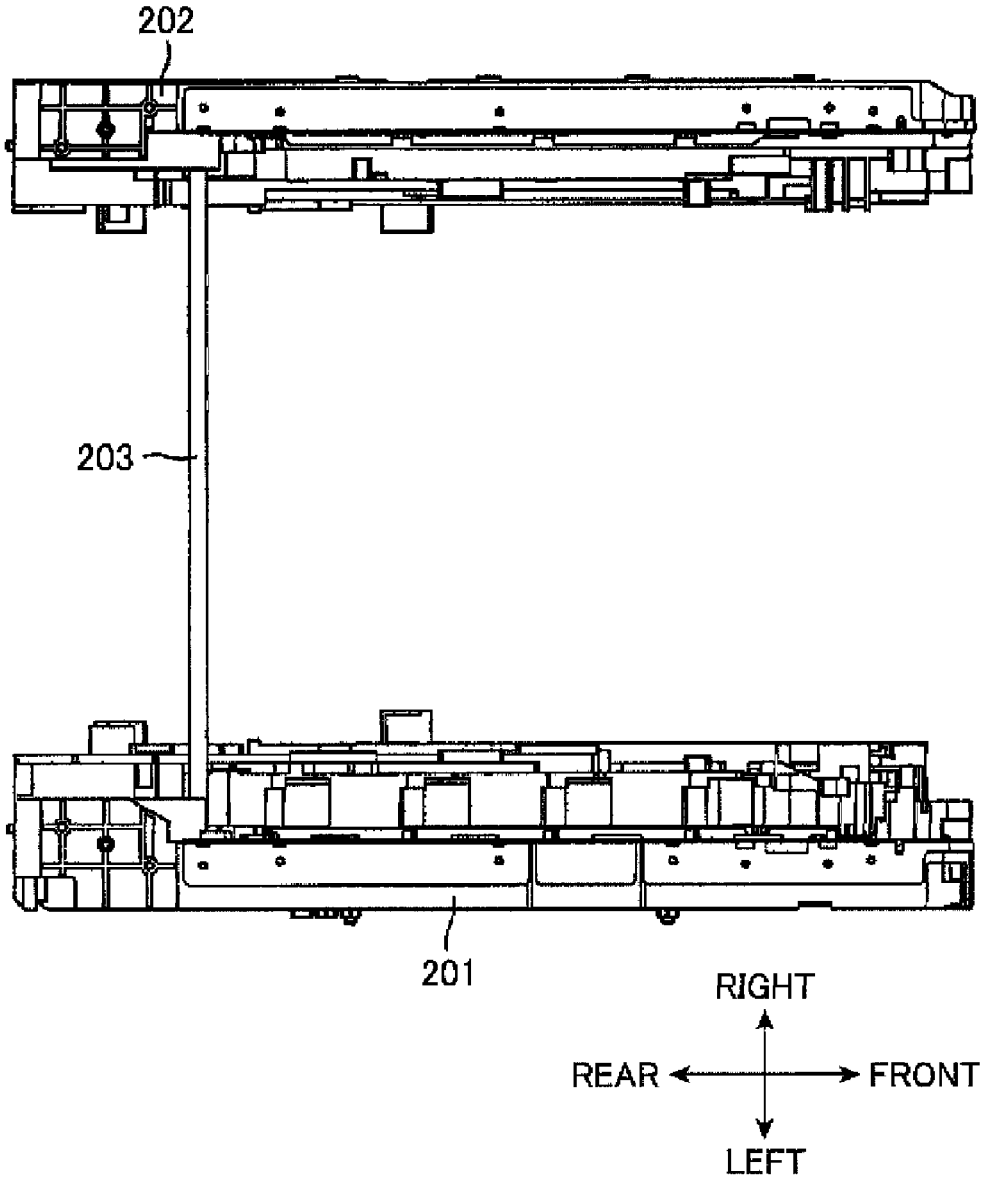
FIG. 7 is a plan view of a left main frame wall and a right main frame wall shown in FIG. 6.
Figure 8:
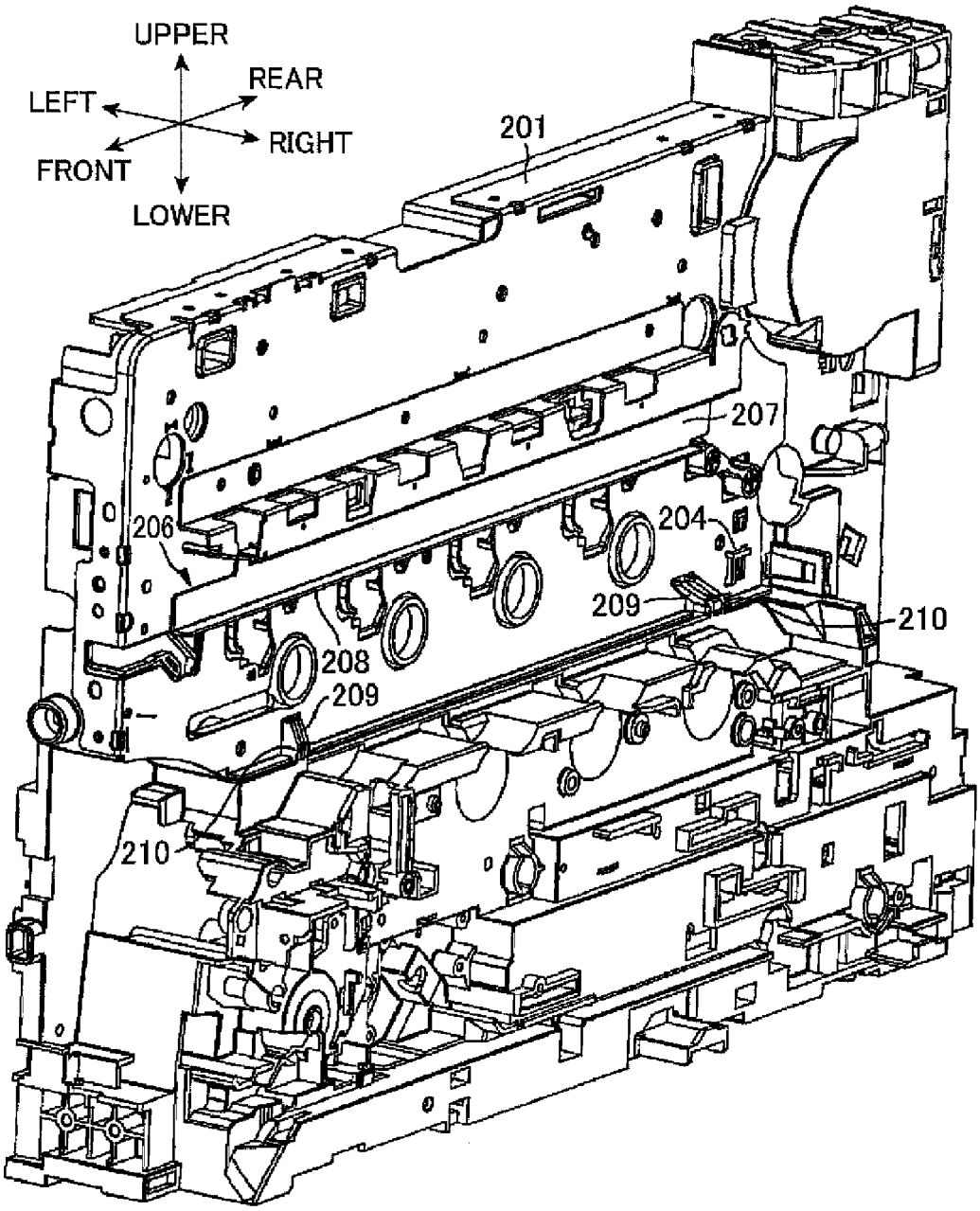
FIG. 8 is a perspective view of the left main frame wall as viewed from the right front side.
Figure 9A:
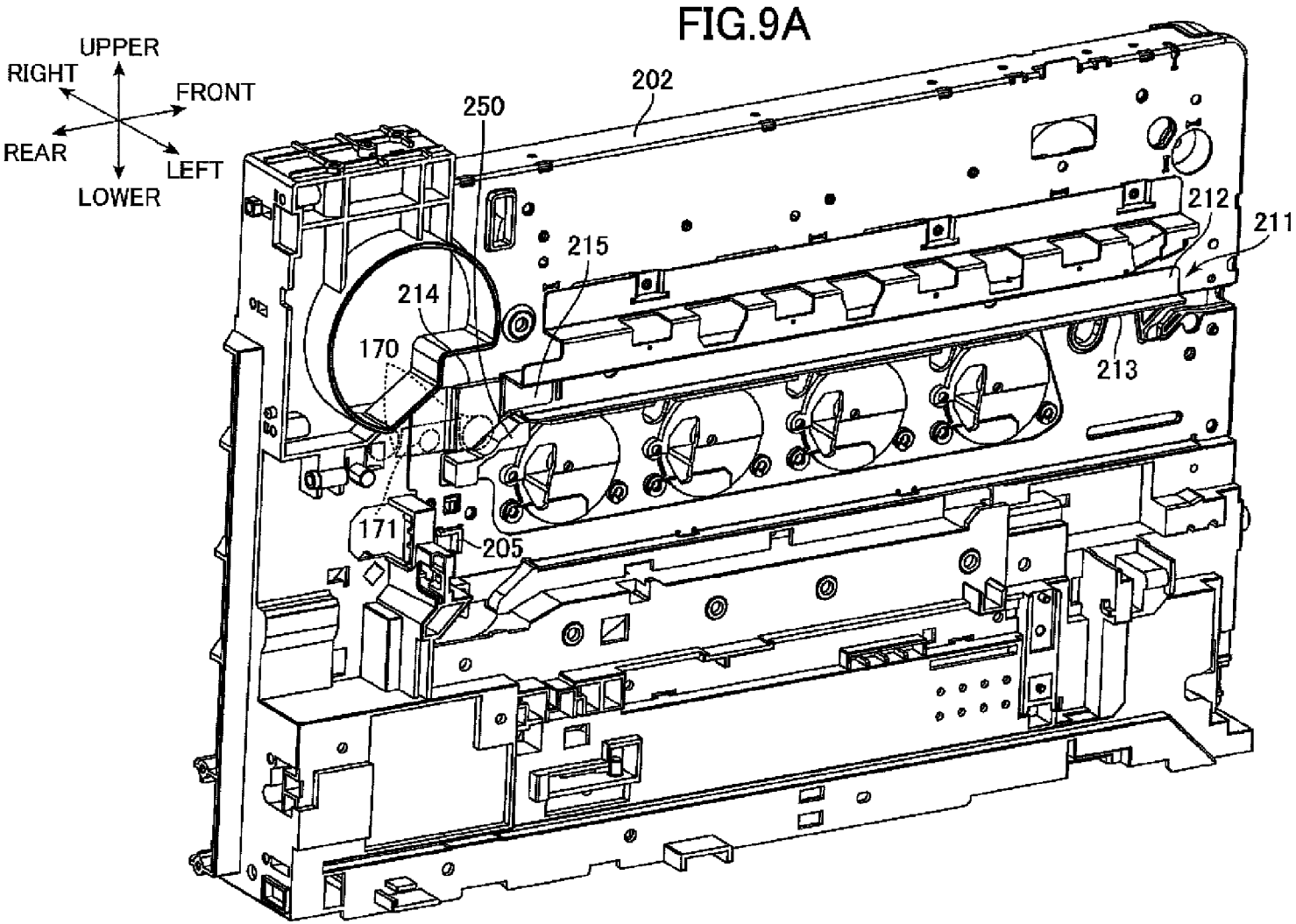
FIG. 9A is a perspective view of the right main frame wall from the left rear side.
Figure 9B:
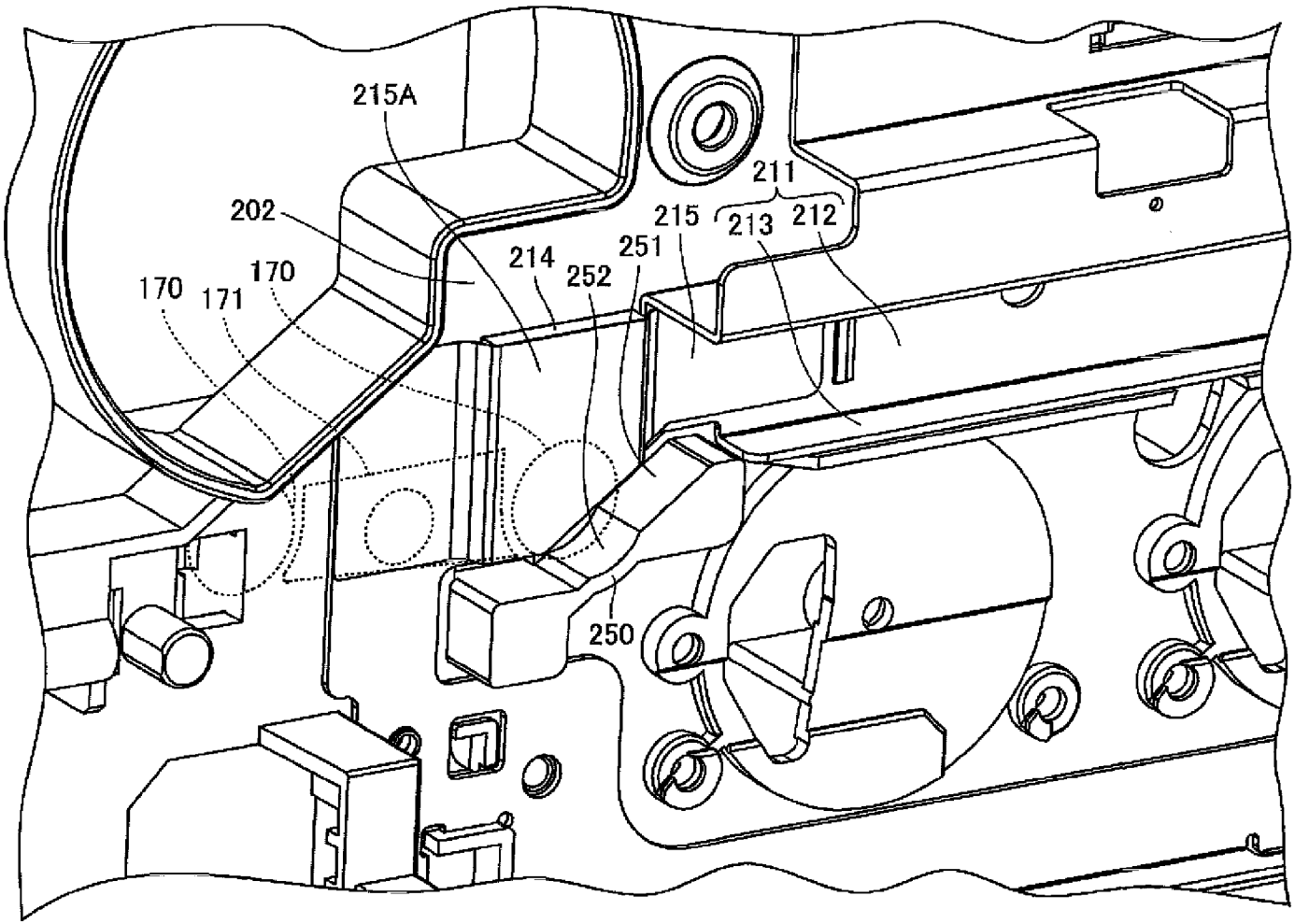
FIG. 9B is an enlarged view of a part of FIG. 9A for particularly showing a friction applying member according to the embodiment.

FIG. 7 is a plan view of the main frame walls 201 and 202. FIG. 8 is a perspective view of the left main frame wall 201 from the right front side. FIG. 9A is a perspective view of the right main frame wall 202 from the left rear side. FIG. 9B is an enlarged view of a part of FIG. 9A for particularly showing a friction applying member 214.

As shown in FIG. 7, the reference shaft 203 spans between rear parts of the main frame walls 201 and 202. As mentioned earlier, the reference shaft 203 is held in the notched parts 160 formed in the side plates 133 of the drum unit 26. More specifically, as shown in FIG. 8, an L-shaped protruding part 204 is provided in the vertical center of the left main frame wall 201 near the rear edge thereof. The protruding part 204 forms an L-shape with a part extending vertically and a part extending rearward from the upper edge of the vertical part. As shown in FIG. 9A, an L-shaped protruding part 205 is provided on the right main frame wall 202 at a position confronting the protruding part 204 in the left-to-right direction. The protruding part 205 forms an L-shape with a part extending vertically and a part extending rearward from the upper edge of the vertical part. The reference shaft 203 spanning between the main frame walls 201 and 202 is disposed so as to contact the L-shaped protruding parts 204 and 205 from the lower and rear sides thereof.

As shown in FIG. 8, a left rail 206 is provided on the inner surface of the left main frame wall 201 at a position above the protruding part 204 for guiding the drum unit 26 when the drum unit 26 is mounted in the main casing 2. The left rail 206 is formed with a substantially L-shaped cross section by a vertical part 207 following the inner surface of the left main frame wall 201 and a horizontal part 208 formed integrally with the vertical part 207 and orthogonal thereto. The left rail 206 extends in the front-to-rear direction (horizontally)

between a position near the front edge of the left main frame wall 201 and a position slightly forward of the protruding part 204.

As shown in FIG. 8, positioning protrusions 209 are provided on the inner surface of the left main frame wall 201. The positioning protrusions 209 are positioned to confront the protruding parts 181 (see FIG. 3) formed on the forwardmost and rearwardmost left caps 180 provided on the drum unit 26 when the drum unit 26 is mounted in the main casing 2. Each of the positioning protrusions 209 has a vertical surface 210, serving as a positioning surface, that faces inwardly toward the drum accommodating space 7 (toward the friction applying member 214).

As shown in FIG. 9A, a right rail 211 is provided on the inner surface of the right main frame wall 202 at a position corresponding to the left rail 206 (see FIG. 8) in the left-to-right direction for guiding the drum unit 26 when the drum unit 26 is mounted in the main casing 2. The right rail 211 is shaped with left-right symmetry to the left rail 206. Specifically, the right rail 211 has an L-shaped cross section and is integrally configured of a vertical part 212 extending along the inner surface of the right main frame wall 202, and a horizontal part 213 orthogonal to the vertical part 212.

The friction applying member 214 is provided on the inner surface of the right main frame wall 202 near the rear end thereof. As shown in FIG. 9B, the friction applying member 214 is a plate-shaped member having a predetermined thickness (a thickness of 3-4 mm, for example) and is formed of micro-cell urethane foam. A PET film 215 covers the surface of the friction applying member 214 and is bonded on one side (front side) of the friction applying member 214 to the vertical part 212 of the right rail 211 and on the other side (rear side) to the inner surface of the right main frame wall 202. The PET film 215 has a friction applying surface 215A for contacting the drum unit 26 (more specifically, the roller members 170) and applying a frictional force. The friction applying surface 215A faces toward the drum accommodating space 7.

4. Configuration for Supplying Power to the Developer Cartridge

Figure 10:
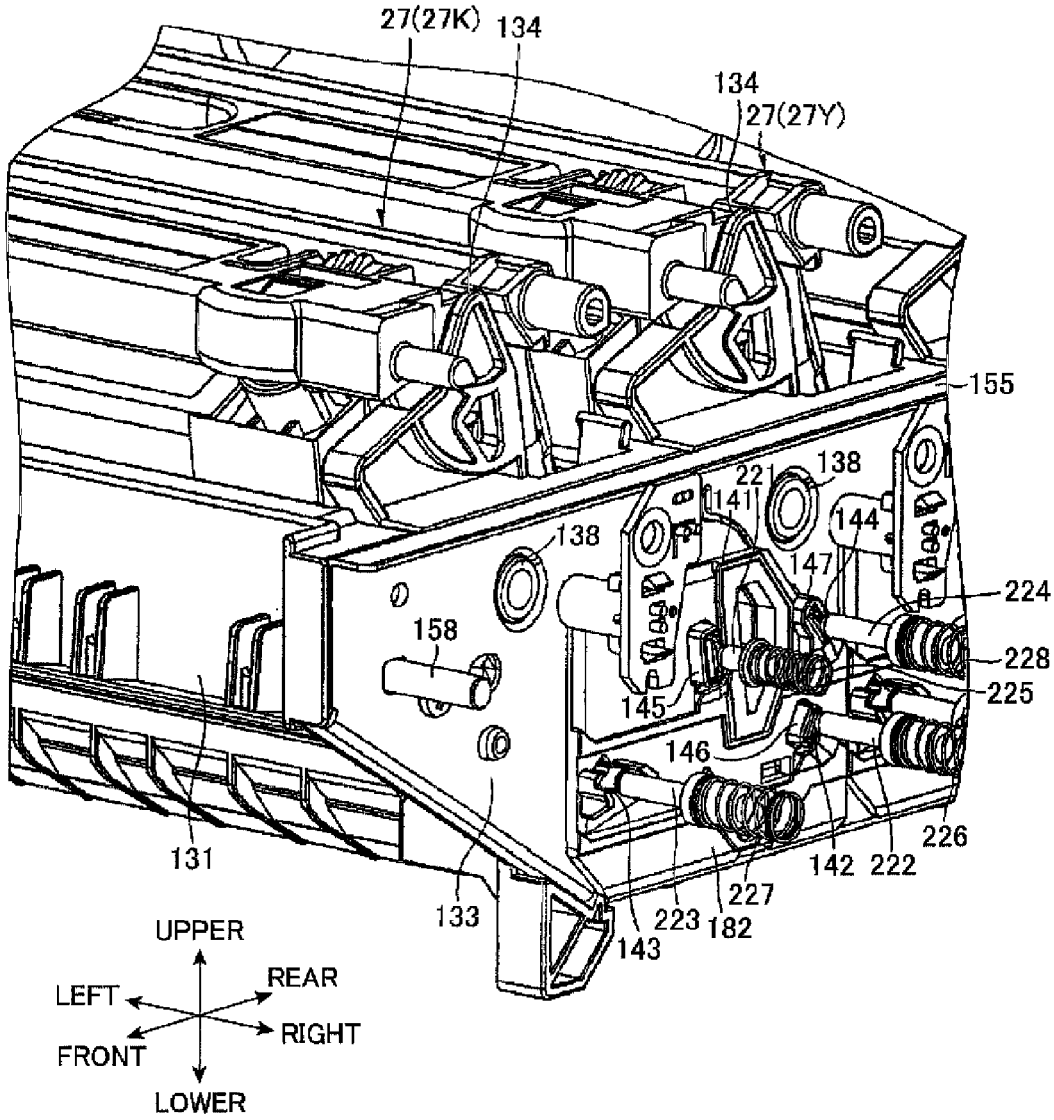
FIG. 10 is a perspective view illustrating the structure for supplying power to the developer cartridge (drum unit)

FIG. 10 is a perspective view illustrating the structure for supplying power to the developer cartridge 27 (drum unit 26).

A wire output terminal 221, a grid output terminal 222, a developing roller output terminal 223, and a cleaning output terminal 224 are all provided inside the main casing 2 and are capable of moving in the left-to-right direction relative to the right main frame wall 202 (see FIG. 9A).

The wire output terminal 221, grid output terminal 222, developing roller output terminal 223, and cleaning output terminal 224 are disposed at positions corresponding to the respective wire electrode 141, grid electrode 142, developing roller electrode 143, and cleaning electrode 144. The wire output terminal 221, grid output terminal 222, developing roller output terminal 223, and cleaning output terminal 224 are urged toward the left by respective springs 225, 226, 227, and 228. The urging force of these springs allows the wire output terminal 221, grid output terminal 222, developing roller output terminal 223, and cleaning output terminal 224 to flexibly contact the respective wire electrode 141, grid electrode 142, developing roller electrode 143, and cleaning electrode 144 from the right side.

5. Mounting the Drum Unit

Figure 11A:
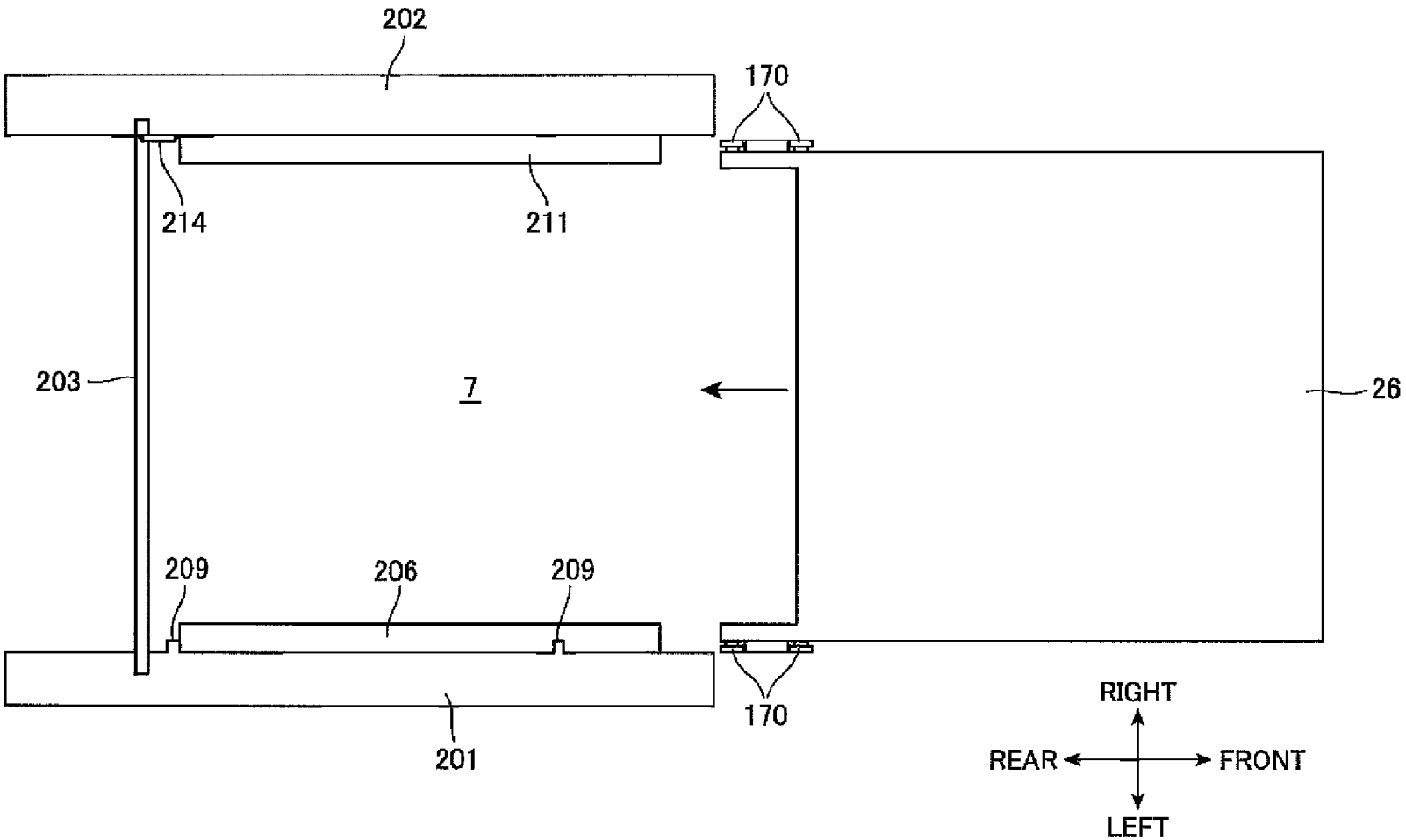
FIG. 11A is a plan view illustrating the process of mounting the drum unit into a drum accommodating space, for particularly showing a state where a rear end of the drum unit is being inserted into the drum accommodating space.
Figure 11B:
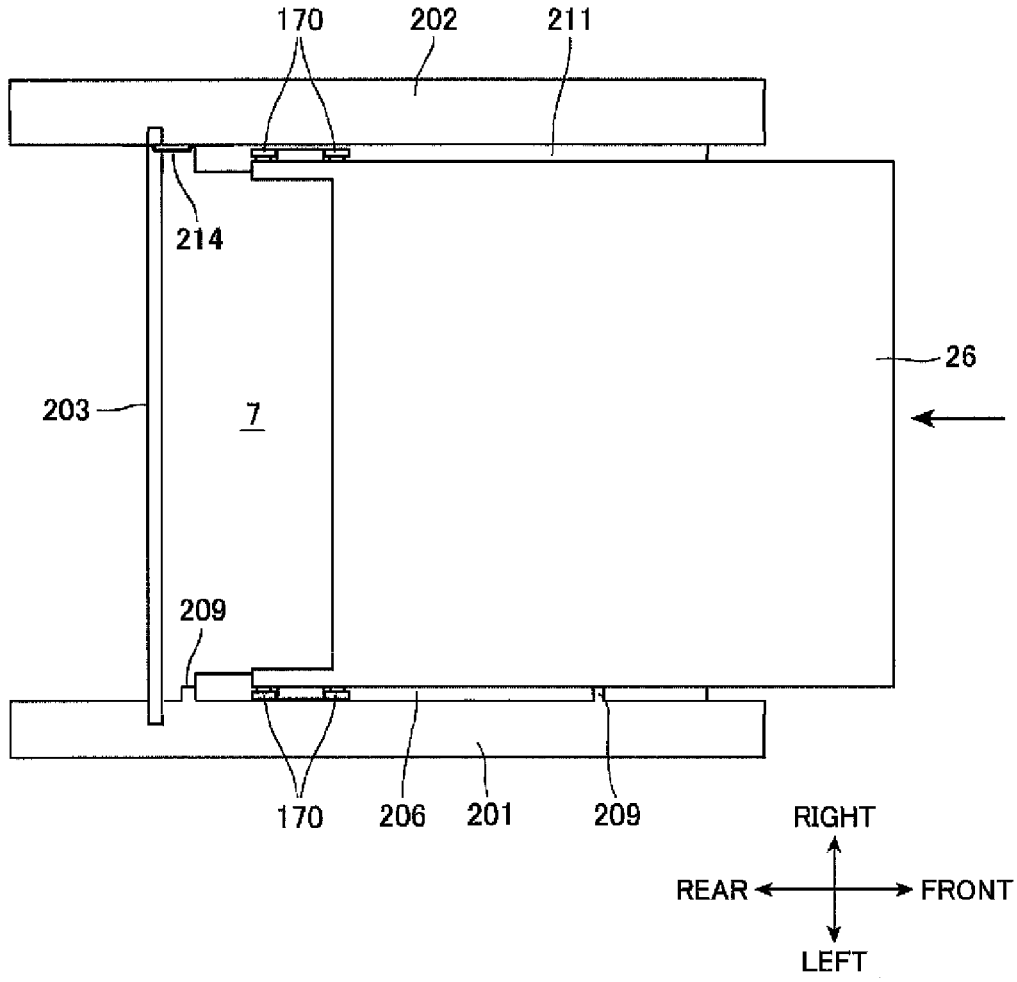
FIG. 11B is a plan view illustrating the process of mounting the drum unit into the drum accommodating space, for particularly showing a state where the drum unit is slidably moved rearward as roller members on left and right sides of the drum unit roll over left and right rails.
Figure 11C:
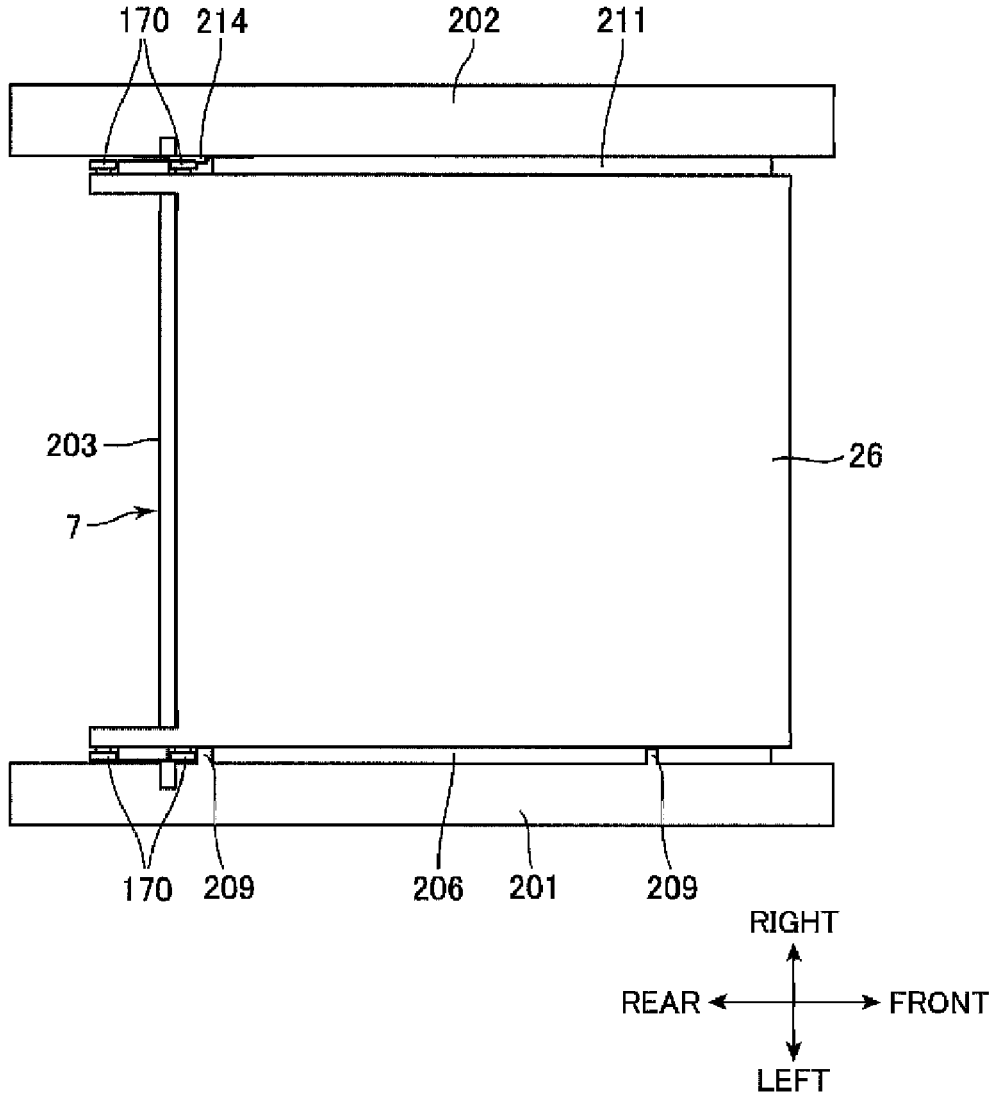
FIG. 11C is a plan view illustrating the process of mounting the drum unit into the drum accommodating space, for particularly showing a state where the roller members of the drum unit run off the rear edge of the left and right rails and a reference shaft is fitted into notched parts of the drum unit.

FIGS. 11A through 11C are plan views illustrating the process for mounting the drum unit 26 in the drum accommodating space 7 in the main casing 2.

When mounting the drum unit 26 in the drum accommodating space 7 in the main casing 2, first the front cover 9 is pivotally moved downward to expose the access opening 8. Next, as shown in FIG. 11A, the operator grips the near-side grip 157 and far-side grip 159 of the drum unit 26 using both hands and inserts the rear end of the drum unit 26 into the main casing 2 through the access opening 8. At this time, the operator places the roller members 170 provided on left and right sides of the drum unit 26 near the rear edge thereof on the respective left rail 206 (horizontal part 208) and right rail 211 (horizontal part 213) and releases the far-side grip 159.

Next, while gripping the near-side grip 157, the operator pushes the drum unit 26 rearward. At this time, as shown in FIG. 11B, the roller members 170 on the left and right sides of the drum unit 26 roll over the left and right rails 206 and 211 as the drum unit 26 is smoothly slidably moved rearward.

When the drum unit 26 reaches a position where the rearmost roller members 170 run off the rear edges of the left and right rails 206 and 211, the friction applying member 214 contacts the right rear roller member 170 from the right side via the PET film 215. The friction applying member 214 applies a frictional force to the roller member 170 that slows the momentum of the drum unit 26. Further, the elasticity of the friction applying member 214 applies a force for pushing the roller member 170 toward the left. Accordingly, after the rear roller members 170 run off the rear edge of the left and right rails 206 and 211, the momentum of the drum unit 26 is reduced, and the rear edge of the drum unit 26 is pushed slightly leftward as the drum unit 26 moves farther toward the rear.

As shown in FIG. 11C, when both roller members 170 on the left and right sides of the drum unit 26 run off the rear edge of the left and right rails 206 and 211, the reference shaft 203 is fitted into the notched parts 160 formed in the side plates 133, thereby restricting movement of the drum unit 26. Note that, as shown in FIGS. 9A and 9B, a roller supporting member 250 is provided to the right main frame wall 202 at the downstream side of the right rail 211. Another roller supporting member (not shown) is similarly provided to the left main frame wall 201. The roller supporting member 250 (FIG. 9B) has a slanted surface 251 that slants down toward the rear, and a roller receiving surface 252 having a concave arc shape for receiving the roller member 170. When both roller members 170 on the left and right sides of the drum unit 26 run off the rear edge of the left and right rails 206 and 211 as described above, the roller members 170 roll down on the slanted surface 251 and the front-side roller member 170 is received by the roller receiving surface 252. The roller members 170 in a received state (at the mount position) are shown in dotted lines in FIGS. 9A and 9B.

At this point, mounting of the drum unit 26 in the drum accommodating space 7 is complete. Subsequently, the operator releases the near-side grip 157 and returns the front cover 9 to its upright position to close the access opening 8.

When the drum unit 26 is in this mounted state, both the upper and lower edges of the notched part 160 are in contact with the reference shaft 203, gripping the reference shaft 203 from above and below. Hence, the drum unit 26 is positioned in both the vertical and front-to-rear directions.

Further, the friction applying member 214 elastically contacts the roller member 170 via the PET film 215 from the right side thereof. At the same time, the wire output terminal 221, grid output terminal 222, developing roller output terminal 223, and cleaning output terminal 224 elastically contact the right sides of the respective wire electrode 141, grid electrode 142, developing roller electrode 143, and cleaning electrode 144 on each drum subunit 28, as shown in FIG. 10, thereby applying a force in the left direction to the drum unit 26. This leftward force causes the protruding parts 181 on the forwardmost and rearwardmost left caps 180 of the drum unit 26 (see FIG. 3) to contact the vertical surfaces 210 (see FIG. 8) of the positioning protrusions 209 provided on the inner surface of the left main frame wall 201, thereby positioning the drum unit 26 in the left-to-right direction.

6. Operations and Effects

As described above, the drum unit 26 is capable of moving relative to the main casing 2 in the juxtaposed direction of the photosensitive drums 29 (front-to-rear direction). The reference shaft 203 is disposed inside the main casing 2. When mounted in the main casing 2, the drum unit 26 is positioned through contact with the reference shaft 203. Further, the friction applying member 214 is disposed in the main casing 2 so as to confront the drum unit 26 in a direction orthogonal to the moving direction of the drum unit 26. Hence, when the drum unit 26 moves toward the mount position in the main casing 2, the friction applying member 214 can apply a frictional force to the drum unit 26. Since the frictional force reduces the moving impetus of the drum unit 26 before the drum unit 26 reaches the mount position, the friction applying member 214 can prevent the drum unit 26 from forcibly impacting the reference shaft 203, thereby preventing damage to the reference shaft 203 and/or the parts of the drum unit 26 that contact the reference shaft 203.

Further, the friction applying member 214 contacts the drum unit 26 from one side (right side) in a direction parallel to the rotational axes of the photosensitive drums 29 (left-to-right direction) to apply a frictional force to the drum unit 26. Specifically, the roller members 170 supported on the left and right rails 206 and 211 are provided on the deep end (rear end) of the drum unit 26 in the moving direction of the drum unit 26. By contacting the roller member 170, the friction applying member 214 applies a frictional force to the drum unit 26. Further, by contacting the drum unit 26 (roller member 170), the friction applying member 214 can push the drum unit 26 toward the other side (left side) in the axial direction of the photosensitive drums 29.

Further, the positioning protrusions 209 with the vertical surfaces 210 are provided in the main casing 2 on the opposite side (left side) of the friction applying member 214 for positioning the mounted drum unit 26 in a direction parallel to the axial direction of the photosensitive drums 29. Hence, when the friction applying member 214 pushes the drum unit 26 in a direction parallel to the axial direction of the photosensitive drums 29, the drum unit 26 contacts the vertical surfaces 210 of the positioning protrusions 209, thereby positioning the drum unit 26 in the axial direction of the photosensitive drums 29.

Further, the wire output terminals 221, grid output terminals 222, developing roller output terminals 223, and cleaning output terminals 224 are disposed inside the main casing 2. The wire output terminals 221, grid output terminals 222, developing roller output terminals 223, and cleaning output terminals 224 elastically contact the corresponding wire electrodes 141, grid electrodes 142, developing roller electrodes 143, and cleaning electrodes 144 of the drum subunit 28 from the right side. In this way, the drum unit 26 is urged in the opposite direction (leftward) along the axial direction of the photosensitive drums 29. By reliably applying a force to the drum unit 26 in a direction parallel to the axes of the photosensitive drums 29, the drum unit 26 can be reliably made to contact the vertical surfaces 210 of the positioning protrusions 209, thereby reliably positioning the drum unit 26 in a direction parallel to the axes of the photosensitive drums 29.

Further, since the wire output terminals 221, grid output terminals 222, developing roller output terminals 223, and cleaning output terminals 224 function also as pressing members for pushing the drum unit 26, fewer components are required than when a separate structure is provided for this function.

The notched parts 160 are formed on the drum unit 26 for receiving the reference shaft 203 when the drum unit 26 is placed in the mount position and for gripping the reference shaft 203 in a vertical direction orthogonal to the mounting direction of the drum unit 26. By receiving the reference shaft 203 in the notched parts 160, the drum unit 26 can be positioned relative to the mounting direction. Further, since the reference shaft 203 is held by the notched parts 160 in the vertical direction orthogonal to the mounting direction when the reference shaft 203 is received in the notched parts 160, the drum unit 26 can be positioned vertically.

Further, the friction applying member 214 is disposed in a position near the deep end of the main casing 2. Hence, when the drum unit 26 is moving toward the mount position in the main casing 2, the friction applying member 214 can apply a frictional force to the drum unit 26 just before the drum unit 26 reaches the mount position, thereby allowing the drum unit 26 to move smoothly to a position just before the mount position, while reducing the momentum of the drum unit 26 when the drum unit 26 is arriving at the mount position. Hence, this construction can prevent damage to the reference shaft 203 and/or parts of the drum unit 26 contacting the reference shaft 203, without hindering movement of the drum unit 26.

Further, the left and right rails 206 and 211 are provided in the main casing 2 for guiding the drum unit 26 to be mounted in the main casing 2, thereby improving operability of the drum unit 26 when the drum unit 26 is mounted in the main casing 2. In addition, the friction applying member 214 disposed near the rear end of the right rail 211 can apply a frictional force to the drum unit 26 just before the drum unit 26 reaches the mount position.

Further, by forming the friction applying member 214 of micro-cell urethane foam, the friction applying member 214 can apply not only a frictional force to the drum unit 26, but also a pressing force due to the elasticity of the micro-cell urethane foam.

Further, by protecting the friction applying member 214 with the PET film 215, the friction applying member 214 can apply a stable frictional force and pressing force to the drum unit 26 over a longer period of time.

7. Modifications

While the invention has been described in detail with reference to the above aspects thereof, it would be apparent to those skilled in the art that various changes and modifications may be made therein without departing from the scope of the claims.

Figure 12A:
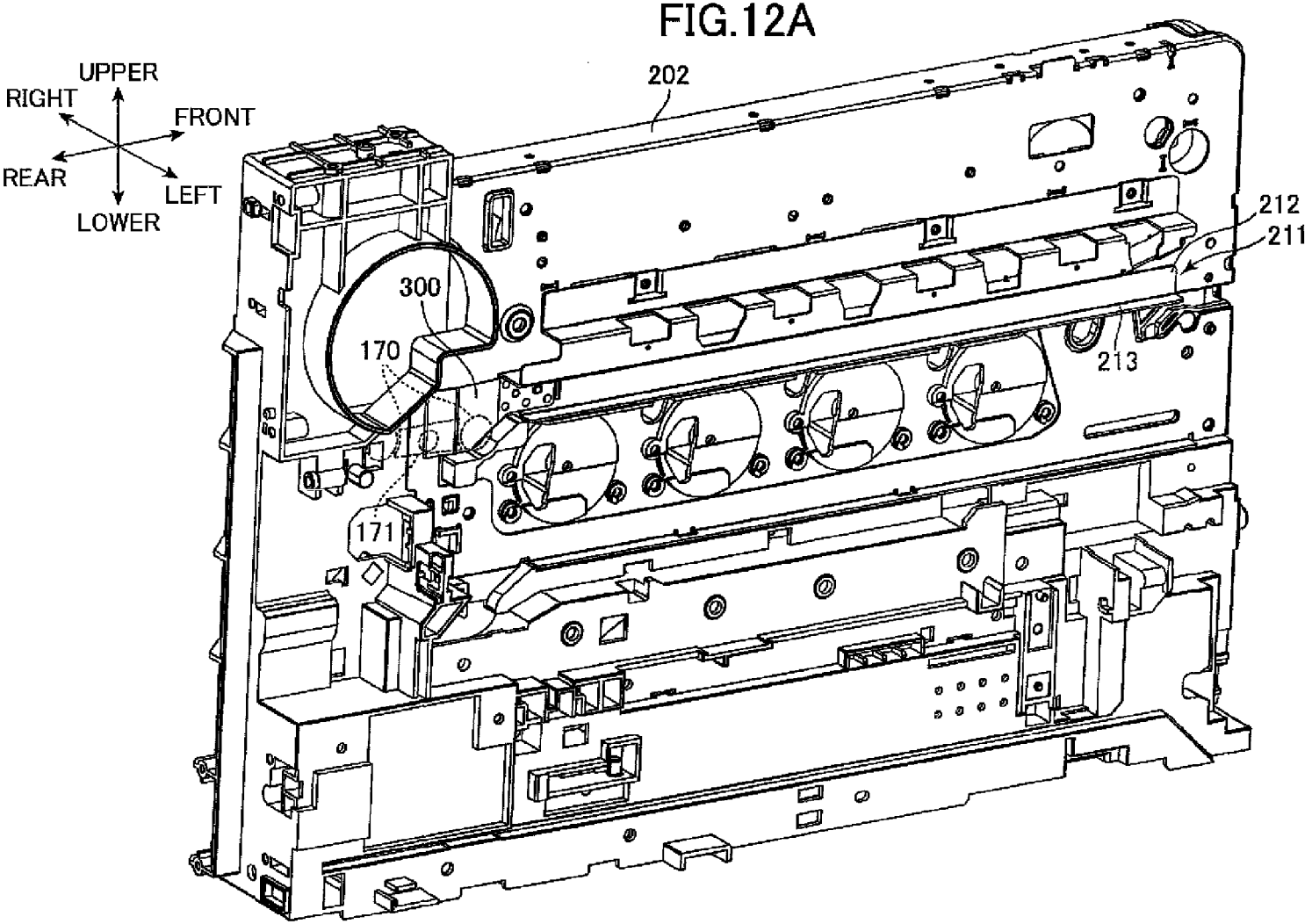
FIG. 12A is a perspective view of the right main frame wall as viewed from the left rear side according to a modification.
Figure 12B:
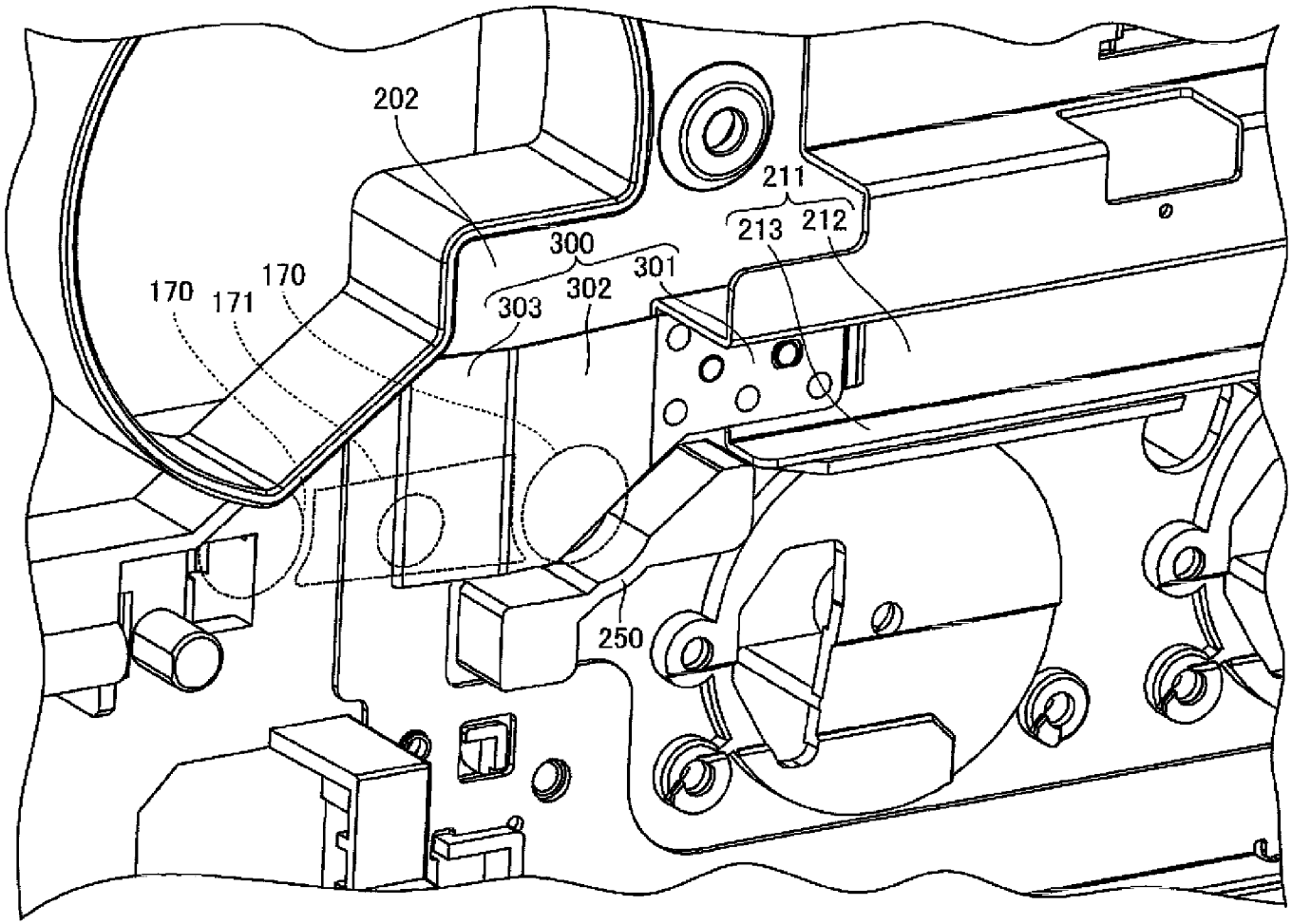
FIG. 12B is an enlarged view of a part of FIG. 12A for particularly showing a friction applying member according to the modification.
Figure 12C:
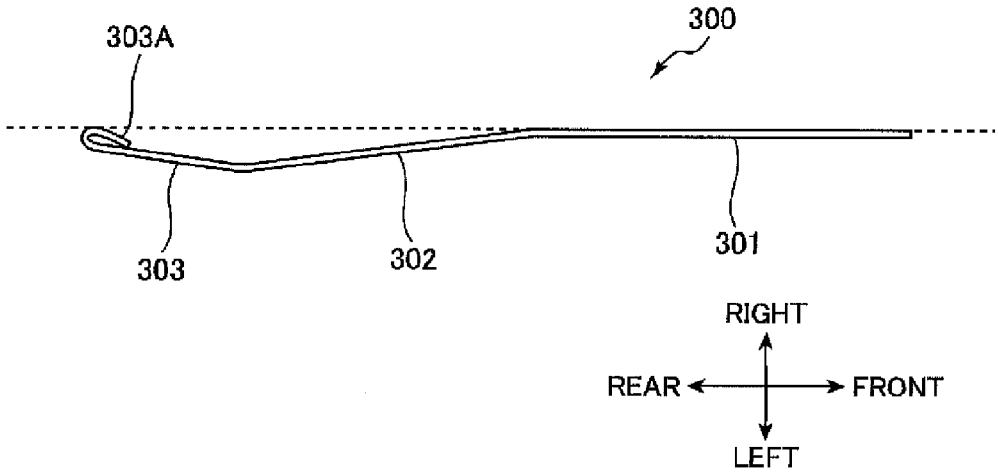
FIG. 12C is a top view of the friction applying member according to the modification.

FIG. 12A is a perspective view of the right main frame wall 202 from the left rear side according to a modification. FIG. 12B is an enlarged view of a part of FIG. 12A for particularly showing a friction applying member 300 according to the modification. FIG. 12C is a top view of the friction applying member 300 according to the modification.

As shown in FIGS. 12A and 12B, the friction applying member 300 is provided to the right main frame wall 202. The friction applying member 300 is formed of sheet metal, and includes a fixed part 301, a first bent part 302, and a second bent part 303. The fixed part 301 is fixed to the right rail 211 by spot welding. As shown in FIGS. 12B and 12C, the first and second bent parts 302 and 303 are bent in a wide V-shape that protrudes leftward (toward inside of the drum accommodating space 7) at the rear side of the right rail 211. As shown in FIG. 12C, the second bent part 303 has an edge part 303A that is folded back toward the front. In this way, the friction applying member 300 has flexibility in the left-to-right direction owing to the flexure (resilience) of the sheet metal.

When mounting the drum unit 26 in the main casing 2, the friction applying member 300 contacts the roller member 170 on the right side of the drum unit 26 from the right when the drum unit 26 arrives at a position in which the rearmost roller members 170 on the left and right sides of the drum unit 26 run off the rear edge (deep side) of the left rail 206 (see FIG. 8) and right rail 211. Accordingly, the friction applying member 300 applies a dynamic frictional force to the roller member 170 to reduce the momentum of the drum unit 26. At this time, the first and second bent parts 302 and 303 (friction applying surface) mainly contact the roller member 170 and apply a frictional force. The flexibility of the friction applying member 300 applies a force to the roller member 170 for pushing the drum unit 26 leftward. Hence, the friction applying member 300 can obtain the same effects as the friction applying member 214 in the above-described embodiment.

While the friction applying member 214 shown in FIG. 9 is formed of micro-cell urethane foam according to the above-described embodiment, the friction applying member 214 may be formed of silicone rubber, synthetic rubber, or a rubber sponge material.

Further, in the above-described embodiment, the image forming apparatus of the invention is applied to a direct transfer-type color laser printer for directly transferring toner images from photosensitive drums 29 to the paper 3. However, the image forming apparatus may be an intermediate transfer-type color laser printer for temporarily transferring color toner images from the photosensitive drums to an intermediate transfer member and subsequently transferring the composite toner image onto the paper.

What is claimed is:

1. An image forming apparatus comprising:

an apparatus main body;

a photosensitive-member unit including a plurality of photosensitive members arranged in a first direction, the photosensitive-member unit being movable in the first direction to be mounted to or dismounted from a mount position in the apparatus main body;

a positioning member that is fixed to the apparatus main body and that is configured to contact the photosensitive-member unit when the photosensitive-member unit is mounted at the mount position, thereby positioning the photosensitive-member unit at the mount position relative to the apparatus main body; and a friction applying member that is provided to one side of the apparatus main body with respect to a second direction perpendicular to the first direction, the photosensitive-member unit being configured to slidingly contact the friction applying member when the photosensitive-member unit moves to the mount position, allowing the friction applying member to apply a frictional force to the photosensitive-member unit, wherein each of the plurality of photosensitive members has a rotational axis extending in the second direction; and wherein the friction applying member is disposed so as to contact the photosensitive-member unit from the second direction.

2. The image forming apparatus according to claim 1, wherein the apparatus main body is formed with a photosensitive-member unit mounting space for accommodating the photosensitive-member unit; and wherein the friction applying member has a friction applying surface that faces in the second direction toward the photosensitive-member unit mounting space.

3. The image forming apparatus according to claim 1, wherein the apparatus main body has a positioning surface that is located at another side of the apparatus main body with respect to the second direction, the positioning surface being configured to contact the photosensitive-member unit mounted at the mount position, thereby positioning the photosensitive-member unit with respect to the second direction.

4. The image forming apparatus according to claim 1, further comprising a pressing member that is provided to the one side of the apparatus main body, the pressing member being configured to elastically contact the photosensitive-member unit mounted at the mount position, thereby pressing the photosensitive-member unit in the second direction.

5. The image forming apparatus according to claim 4, further comprising a plurality of developing units that is detachably mounted on the photosensitive-member unit for supplying developer to respective ones of the plurality of photosensitive members, wherein the pressing member serves as a terminal that supplies electrical power to the plurality of developing units.

6. The image forming apparatus according to claim 1, wherein the positioning member comprises an axial member that extends in the second direction; and wherein the photosensitive-member unit is formed with a notched part that receives the axial member when the photosensitive-member unit is mounted at the mount position.

7. The image forming apparatus according to claim 6, wherein the notched part has edges that grips the axial member in a third direction intersecting with the first direction.

8. The image forming apparatus according to claim 1, wherein the apparatus main body has an upstream end and a downstream end with respect to a mounting direction in which the photosensitive-member unit is mounted; and wherein the friction applying member is disposed at a position closer to the downstream end than to the upstream end.

9. The image forming apparatus according to claim 8, further comprising a guide rail disposed in the apparatus main body and extending in the first direction, the guide rail being configured to guide movement of the photosensitive-member unit in the first direction, wherein the friction applying member is disposed at a downstream side of the guide rail with respect to the mounting direction.

10. The image forming apparatus according to claim 9, wherein the photosensitive-member unit has a guide-rail supported member provided to a downstream end of the photosensitive-member unit in the mounting direction, the guide-rail supported member being supported by the guide rail when the photosensitive-member unit moves to the mount position; and wherein the friction applying member is configured to contact the guide-rail supported member when the photosensitive-member unit moves to the mount position, thereby applying the frictional force to the photosensitive-member unit.

11. The image forming apparatus according to claim 10, wherein the guide-rail supported member comprises a roller member that rolls on the guide rail.

12. The image forming apparatus according to claim 11, further comprising a roller supporting member provided to the apparatus main body at a position downstream of the guide rail in the mounting direction, the roller supporting member having:

a slanted surface that slants down toward a downstream side in the mounting direction; and a roller receiving surface having a concave arc shape for receiving the roller member when the photosensitive-member unit is in the mount position.

13. The image forming apparatus according to claim 1, wherein the friction applying member is made of micro-cell urethane foam.

14. The image forming apparatus according to claim 1, wherein the friction applying member comprises a plate-shaped member having a predetermined thickness.

15. The image forming apparatus according to claim 14, further comprising a film member that covers the friction applying member.

16. The image forming apparatus according to claim 1, wherein the friction applying member is formed of sheet metal.

17. The image forming apparatus according to claim 1, further comprising a guide rail disposed in the apparatus main body and extending in the first direction, the guide rail being configured to guide movement of the photosensitive-member unit in the first direction, wherein the apparatus main body is formed with a photosensitive-member unit mounting space for accommodating the photosensitive-member unit; and wherein the friction applying member comprises a sheet-like member including:

a fixed part that is fixed to the guide rail; and a bent part that is bent in a wide V-shape that protrudes toward inside of the photosensitive-member unit mounting space, the bent part being located a downstream side of the guide rail with respect to a mounting direction in which the photosensitive-member unit is mounted.

18. An image forming apparatus comprising:

an apparatus main body formed with an opening;

a sliding unit slidable to be mounted to or dismounted from a mount position in the apparatus main body through the opening;

a developing cartridge wherein the sliding unit is configured to detachably mount the developing cartridge thereon; and a friction applying member disposed in the apparatus main body, wherein the sliding unit is configured to slidingly contact the friction applying member when the sliding unit slides to the mount position, allowing the friction applying member to apply a frictional force to the sliding unit, wherein:

the sliding unit is slidable in a first direction; and the friction applying member is disposed so as to contact the sliding unit from a second direction orthogonal to the first direction.

19. An image forming apparatus comprising:

an apparatus main body formed with an opening;

a developing cartridge;

a sliding unit slidable to be mounted to or dismounted from a mount position in the apparatus main body through the opening, the sliding unit being configured to detachably mount the developing cartridge thereon; and a friction applying member configured to generate a frictional force to reduce a momentum of the sliding unit when the sliding unit slides to the mount position, wherein:

the sliding unit is slidable in a first direction; and the friction applying member is located between the apparatus main body and the sliding unit in a second direction orthogonal to the first direction when the sliding unit is in the mount position in the apparatus main body.

* * * * *